US006213929B1

(12) United States Patent
May

(10) Patent No.: US 6,213,929 B1
(45) Date of Patent: Apr. 10, 2001

(54) MOTOR DRIVEN CENTRIFUGAL FILTER

(75) Inventor: David F. May, Columbus, IN (US)

(73) Assignee: Analytical Engineering, Inc., Columbus, IN (US)

( * ) Notice: Subject to any disclaimer, the term of this patent is extended or adjusted under 35 U.S.C. 154(b) by 0 days.

(21) Appl. No.: 09/352,294

(22) Filed: Jul. 12, 1999

Related U.S. Application Data

(63) Continuation-in-part of application No. 09/176,689, filed on Oct. 21, 1998.

(60) Provisional application No. 60/108,830, filed on Nov. 18, 1998, and provisional application No. 60/101,804, filed on Sep. 25, 1998.

(51) Int. Cl.[7] ..... B04B 9/02; B04B 9/06

(52) U.S. Cl. ..... 494/24; 494/36; 494/49; 494/62; 494/84

(58) Field of Search ..... 494/24, 36, 37, 494/43, 45, 49, 62, 64, 84, 901; 210/168, 171, 232, 354, 360.1, 380.1, 416.5; 184/6.24

(56) References Cited

U.S. PATENT DOCUMENTS 2,129,992 * 9/1938 De Mattia .
2,256,951 * 9/1941 Van Riel .
2,647,686 * 8/1953 Drury ..... 494/36
2,745,217 * 5/1956 Gold et al. .
3,007,629 * 11/1961 Boyland .
3,223,315 * 12/1965 Smith .
3,228,597 * 1/1966 Walker et al. .
3,403,848 * 10/1968 Windsor et al. .
3,432,091 * 3/1969 Beazley .
3,879,294 * 4/1975 Ellis et al. .
4,106,689 * 8/1978 Kozulla .
4,165,032 * 8/1979 Klingenberg .
4,221,323 * 9/1980 Courtot .
4,234,123 * 11/1980 Cory .
4,406,651 * 9/1983 Dudrey et al. ..... 494/62
4,492,631 * 1/1985 Martin ..... 494/901
4,557,831 * 12/1985 Lindsay et al. ..... 210/232
4,891,041 * 1/1990 Hohmann et al. ..... 494/62
5,364,335 * 11/1994 Franzen et al. ..... 494/62
5,494,579 * 2/1996 Robatel et al. ..... 210/380.1
5,505,684 * 4/1996 Piramoon ..... 494/84
5,656,164 * 8/1997 Vado et al. ..... 494/36
5,674,392 * 10/1997 Christophe et al. ..... 494/49
5,707,519 * 1/1998 Miller et al. ..... 210/360.1
5,779,618 * 7/1998 Onodera et al. ..... 494/901
5,879,279 * 3/1999 Berger et al. ..... 494/84
6,017,300 1/2000 Herman ..... 494/49

* cited by examiner

*Primary Examiner*—Charles E. Cooley
(74) *Attorney, Agent, or Firm*—Taylor & Aust, P.C.

(57) ABSTRACT

A centrifugal filter assembly for filtering particulates from engine oil includes a housing with a threaded connector. A filter disposed within the housing is rotatable relative to the housing about an axis of rotation. The filter has an inlet and an outlet for the oil. A filter head includes a mating threaded connector configured to mate with the housing threaded connector. The filter head includes a venturi section in communication with the outlet. The venturi section is configured to create a vacuum within the housing for drawing oil through the outlet. A brushless direct current motor carried by the filter head has a rotatable output shaft coupled with the filter for rotating the filter about the axis of rotation. A controller carried by the filter head controls operation of the motor. The controller includes a printed circuit board disposed within the filter head which carries the motor.

27 Claims, 27 Drawing Sheets

324
330
326
342
340
346
350
348
328
306
334
364
368
332
338
336
304
354
360

MOTOR DRIVEN CENTRIFUGAL FILTER

CROSS REFERENCE TO RELATED APPLICATIONS

This is a non-provisional patent application based upon U.S. Provisional Patent Application Ser. No. 60/108,830, entitled "ELECTRIC MOTOR DRIVEN CENTRIFUGAL FILTER", filed Nov. 18, 1998; and is also a continuation-in-part of U.S. patent application Ser. No. 09/176,689, entitled CENTRIFUGAL FILTER AND METHOD OF OPERATING SAME, filed Oct. 21, 1998, which is a non-provisional patent application based upon U.S. Provisional Patent Application Ser. No. 60/101,804, entitled "AUXILIARY POWERED CENTRIFUGAL FILTER", filed Sep. 25, 1998.

BACKGROUND OF THE INVENTION

1. Field of the Invention

The present invention relates to centrifugal filters for filtering particulates from a liquid using centrifugal force.

2. Description of the Related Art

Many types of fluids contain particulates which need to be filtered out for subsequent use of the fluid. Examples of such fluids include medical and biological fluids, machining and cutting fluids, and lubricating oils. With particular reference to an internal combustion engine, a lubricating oil such as engine oil may contain particulates which are filtered out to prevent mechanical or corrosive wear of the engine.

Diesel engine mechanical wear, especially that relating to boundary lubricated wear, is a direct function of the amount of particulates in the lubricating oil. A particulate which is extremely detrimental to engine wear is soot, formed during the combustion process, and deposited into the crankcase through combustion gas blow-by and piston rings scraping of the cylinder walls. Soot is a carbonaceous polycyclic hydrocarbon which has extremely high surface area whereby it interacts chemically with adsorptive association with other lubricant species. Particle sizes of most diesel engine lubricant soot is between 100 Angstroms and 3 microns. Ranges of concentration are between 0 and 10 percent by weight depending on many factors. Because engine wear will dramatically increase with the soot level in the lubricating oil, engine manufacturers specify a certain engine drain oil interval to protect the engine from this type of mechanical wear. Current sieve type filters do not remove sufficient amounts of soot to provide soot related wear protection to the engine.

Centrifugal filters for lubricant filtration are generally known. Current production centrifugal lubricant oil filters are powered by hero turbines, which are part of the oil filter canister, or through direct mechanical propulsion. Hero turbine powered filters are limited by the supplied oil pressure from the engine, and only can operate up to maximum speeds around 4000 revolutions per minute (RPM) with oil pressures nominally at less than 40 psi. In addition, hero turbine powered filters pass oil through the filter canister as it migrates toward the attached hero turbine jets. Therefore, the lubricant mean residence time is less than a few minutes. None of the currently available centrifugal filters which operate on the basis of a hero turbine provide satisfactory soot removal rates. Soot removal from engine lubricating oil requires greater G forces and longer residence times than is demonstrated with currently commercially available hero turbine powered filters.

It is also known to drive a centrifugal filter using a mechanical linkage from a turbine. The turbine receives a flow of engine exhaust air and drives a mechanical output shaft which in turn is coupled with a filter inside a centrifugal filter assembly. The rotational speed of the filter is sufficient to separate particulates within the engine oil. An example of such a filter is disclosed in U.S. Pat. No. 5,779,618 (Onodera, et al.).

All of the units described above and others commercially available fall generally in groups of hero turbine design or direct mechanical actuation. While direct mechanically driven systems are capable of reaching the necessary G forces to provide soot removal, this type of linkage is generally very expensive and requires extensive modification of engines to adapt. While hero turbines do not suffer from this problem, insufficient G forces limit these filters from removing soot.

SUMMARY OF THE INVENTION

The present invention provides a centrifugal filter assembly which is driven by a brushless direct current motor and includes a venturi section.

The invention comprises, in one form thereof, a centrifugal filter assembly for filtering particulates from engine oil. A housing includes a threaded connector. A filter disposed within the housing is rotatable relative to the housing about an axis of rotation. The filter has an inlet and an outlet for the oil. A filter head includes a mating threaded connector configured to mate with the housing threaded connector. The filter head includes a venturi section in communication with the outlet. The venturi section is configured to create a vacuum within the housing for drawing oil through the outlet. A brushless direct current motor carried by the filter head has a rotatable output shaft coupled with the filter for rotating the filter about the axis of rotation. A controller carried by the filter head controls operation of the motor. The controller includes a printed circuit board disposed within the filter head which carries the motor.

An advantage of the present invention is that the rotating filter is driven by the brushless DC motor at a speed which is sufficient to filter soot from the engine oil.

Another advantage is that the filter head includes a venturi section which generates a vacuum within the housing to remove filtered oil from the housing.

Yet another advantage is that the motor may be carried by a printed circuit board within the filter head, thereby reducing the size of the filter assembly.

Still another advantage is that the filter may be detachably engaged by the motor in the filter head, thereby allowing the filter to be used as a spin-on filter.

A still further advantage is that the housing includes two annular seals with an annular groove therebetween which is in communication with a drain tube, thereby further enabling use as a spin-on filter.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
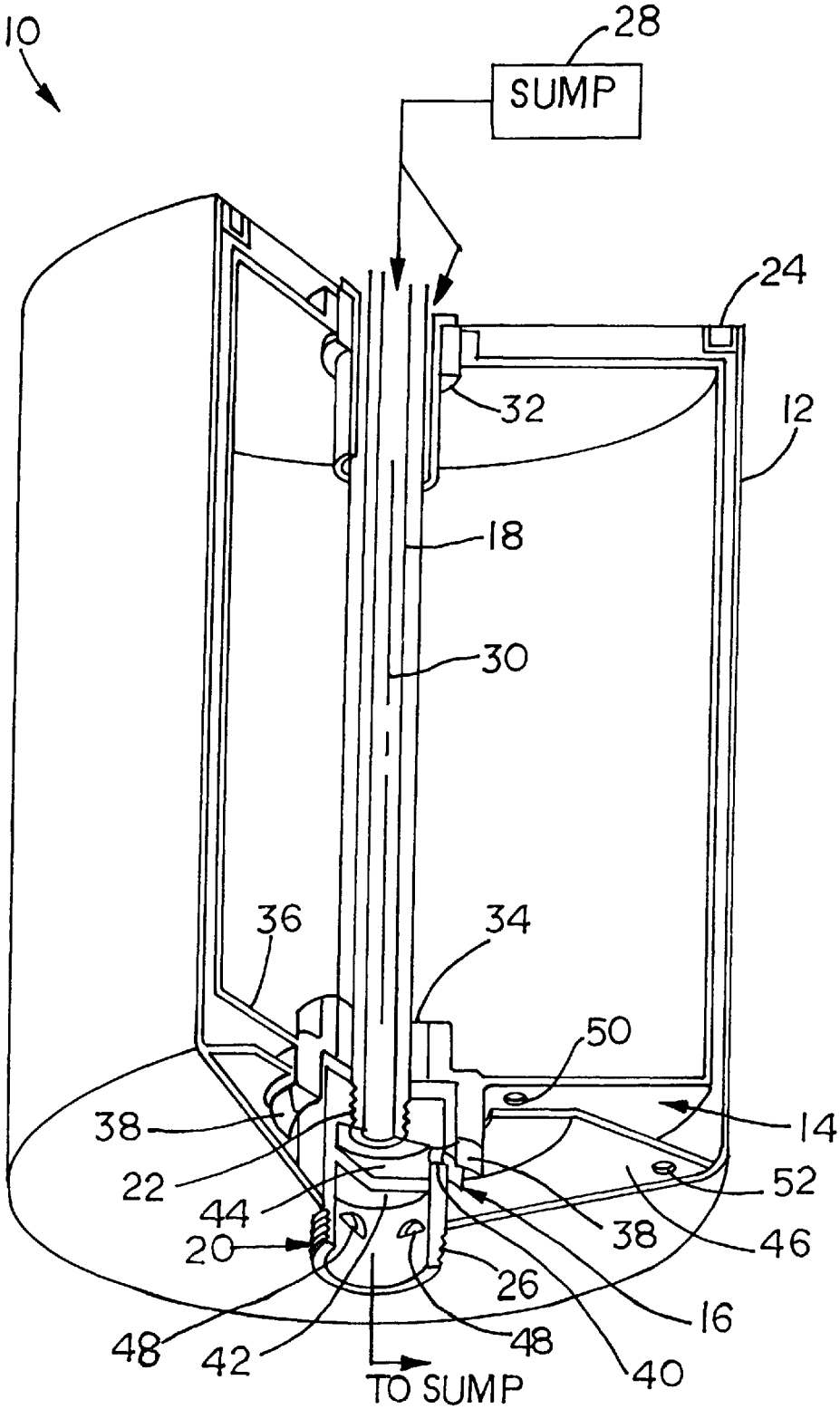
FIG. 1 is a perspective, sectional view of an embodiment of a centrifugal filter assembly of the present invention.

Referring now to the drawings, and more particularly to FIG. 1, there is shown an embodiment of a centrifugal filter assembly 10 of the present invention for filtering particulates from a fluid. For example, centrifugal filter assembly 10 may be used to filter soot from engine oil in a diesel engine, and will be described accordingly. Centrifugal filter assembly 10 may be used for other applications, such as medical applications for separating particulates from a bodily or medical fluid, or machining and cutting applications for separating metallic particles from a hydraulic fluid or lubricating oil.

Centrifugal filter assembly 10 generally includes a housing 12, rotating filter 14 and turbine 16. Housing 12 contains filter 14 and defines a generally fluid-tight vessel. For example, housing 12 may be used as part of a bypass filter assembly for use with an internal combustion engine. When configured as such, a central supply tube 18 disposed in communication with a sump 28 extends outwardly from the engine. Housing 12 includes a hub 20 which is rigidly attached therewith. Hub 20 includes an internal threaded portion 22 which threadingly engages external threads on supply tube 18. Screwing hub 20 onto supply tube 18 causes housing 12 to axially seal against the engine. An annular seal 24 on an axial end face of housing 12 effects a fluid tight seal with the engine. Hub 20 includes external threads 26 allowing attachment with suitable fluid conduits (not shown) for recirculating oil transported through filter assembly 10 back to sump 28.

Filter 14 is disposed within and rotatable relative to housing 12 about an axis of rotation 30 defined by supply tube 18. Filter 14 may be rotatably carried using a pair of reduced friction bearings 32 and 34 disposed at each axial end thereof. Bearings 32 and 34 may be, e.g., roller bearings, ball bearings or another type of reduced friction bearing supports such as a bushing. Filter 14 may include a suitable medium therein (not shown) allowing filtration of the fluid which is transported through filter 14. For example, the medium disposed within filter 14 may be in the form of a spiral wrapped and embossed sheet of metal or plastic material, as will be described in greater detail hereinafter.

Turbine 16 is connected to filter 14 at an axial end thereof. In the embodiment shown, turbine 16 is attached to a bottom wall 36 of filter 14 via welding, a suitable adhesive or the like. The interconnection between turbine 16 and filter 14 causes rotation of turbine 16 to in turn rotate filter 14 about axis of rotation 30.

Turbine 16 includes a plurality of blades 38 which extend generally radially relative to axis of rotation 30. Blades 38 may extend substantially through axis of rotation 30, or may be positioned at an angle offset from axis of rotation 30. Moreover, blades 38 may be configured with a particular shape which is curved, straight, segmented, a combination of the same, etc., to provide a desired rotational speed of filter 14 during operation.

Hub 20 of housing 12 includes at least one fluid port 40 defining a nozzle through which a pressurized fluid is jetted to impact upon turbine blades 38. In the embodiment shown, hub 20 includes a single fluid port 40 defining a nozzle, although a greater number of fluid ports may also be provided. A wall 42 disposed within hub 20 defines a pressure chamber 44 in communication with each of an internal bore of supply tube 18 and fluid port 40. The pressurized fluid is transported through supply tube 18 into pressure chamber 44 and is jetted from fluid port 40. The pressurized fluid which is jetted from fluid port 40 sequentially impinges upon blades 38 of turbine 16. The pressurized fluid is jetted from fluid port 40 in a direction which is substantially perpendicular to axis of rotation 30, thereby eliminating force vectors in a direction parallel to axis of rotation 30 and maximizing the force imparted on each blade 38. The curvature and/or positioning of each blade 38 causes a rotational moment to be exerted on turbine 16, which in turn causes turbine 16 and filter 14 to rotate about axis of rotation 30.

A splash shield 46 is attached to housing 12 and is disposed radially around turbine 16 above blades 38. Pressurized fluid which is jetted radially outwardly from fluid port 40 against turbine blades 38 falls to a bottom of housing 12 and exits through drain holes 48 in hub 20. Splash shield 46 prevents an appreciable amount of pressurized fluid from spraying against a side wall of housing 12 and impacting against filter 14. Impact of the pressurized fluid would provide aerodynamic drag on filter 14 and slow the rotational speed thereof. A relatively small radial clearance is provided between turbine 16 and splash shield 46 to minimize the amount of pressurized fluid which flows past splash shield 46 to an area adjacent filter 14.

Filter 14 fills with oil to be filtered during operation. One or more exit holes 50 are provided in the bottom side of filter 14. The size and number of holes 50, as well as the fluid input rate into filter 14 is a function of the desired throughput rate through filter 14 and residence time of the fluid within filter 14. Engine oil which drains through holes 50 in the bottom of filter 14 flows down the top of splash shield 46, through one or more holes 52 in splash shield 46, and out through drain holes 48 in hub 20.

During use, a pressurized fluid is transported from sump 28 to supply tube 18. When used with an internal combustion engine, the pressurized fluid may be in the form of engine oil which is pressurized using an oil pump to a pressure of between 30 and 70 pounds per square inch (psi), and more particularly approximately 45 psi. Approximately 90 percent (which actual percentage may vary) of the circulated engine oil is transported through supply tube 18 to pressure chamber 44 for discharging in a generally radially outward direction relative to axis of rotation 30 against turbine blades 38 of turbine 16. The pressurized engine oil causes turbine 16 to rotate at a speed of between approximately 5,000 and 20,000 revolutions per minute (RPM), more preferably between approximately 10,000 and 20,000 RPM. The remaining 10 percent of the engine oil is transported into filter 14 for centrifugal filtration. The high rotational speed of filter 14 creates a G force which is high enough to cause centrifugal separation of particulates carried within the engine oil. The particulates migrate radially outwardly within filter 14 and are contained within filter 14. Periodic changing of filter 14 allows the trapped particulates within filter 14 to be merely discarded along with filter 14.

Figure 2:
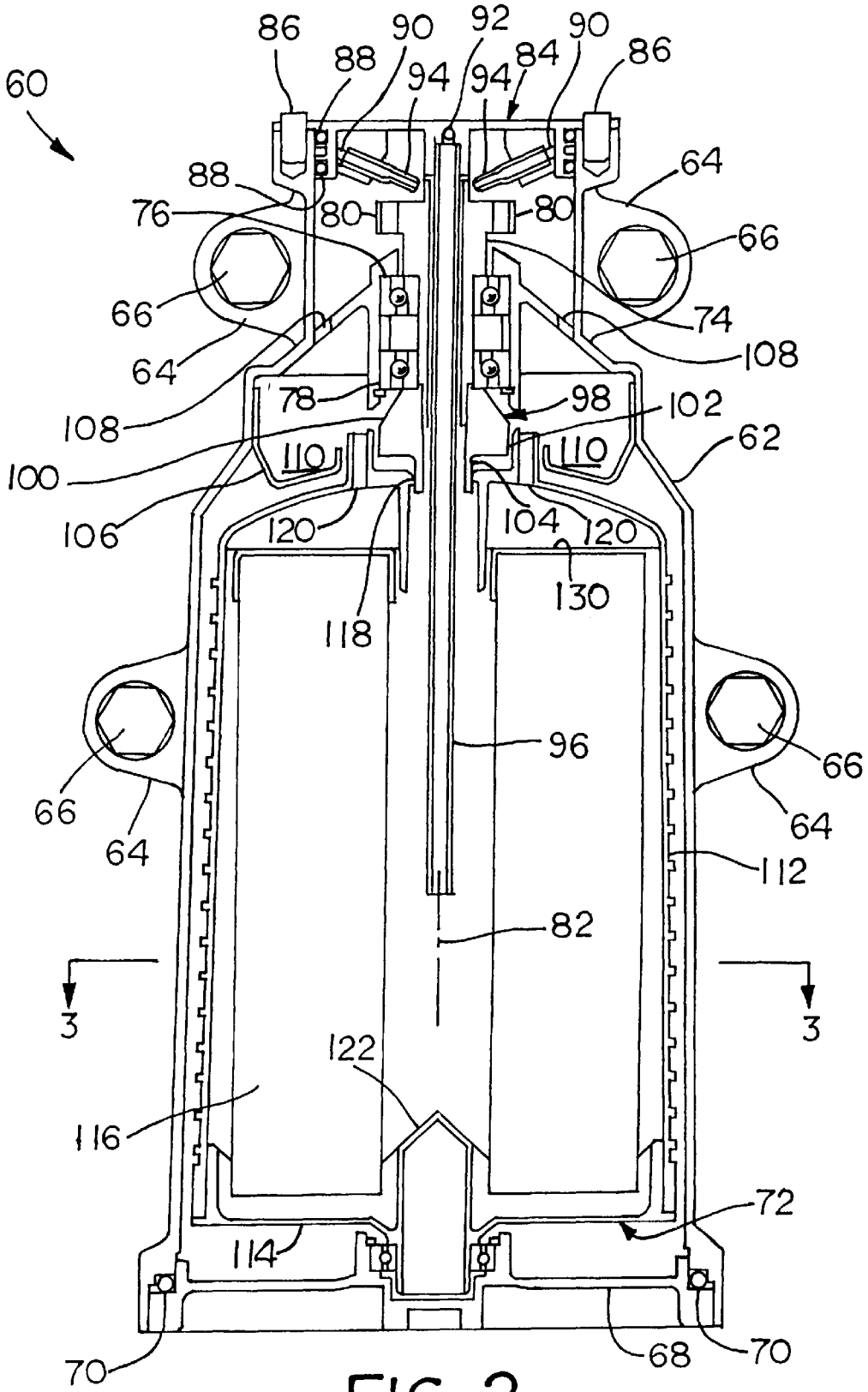
FIG. 2 is a side, sectional view of another embodiment of a centrifugal filter assembly of the present invention.
Figure 3:
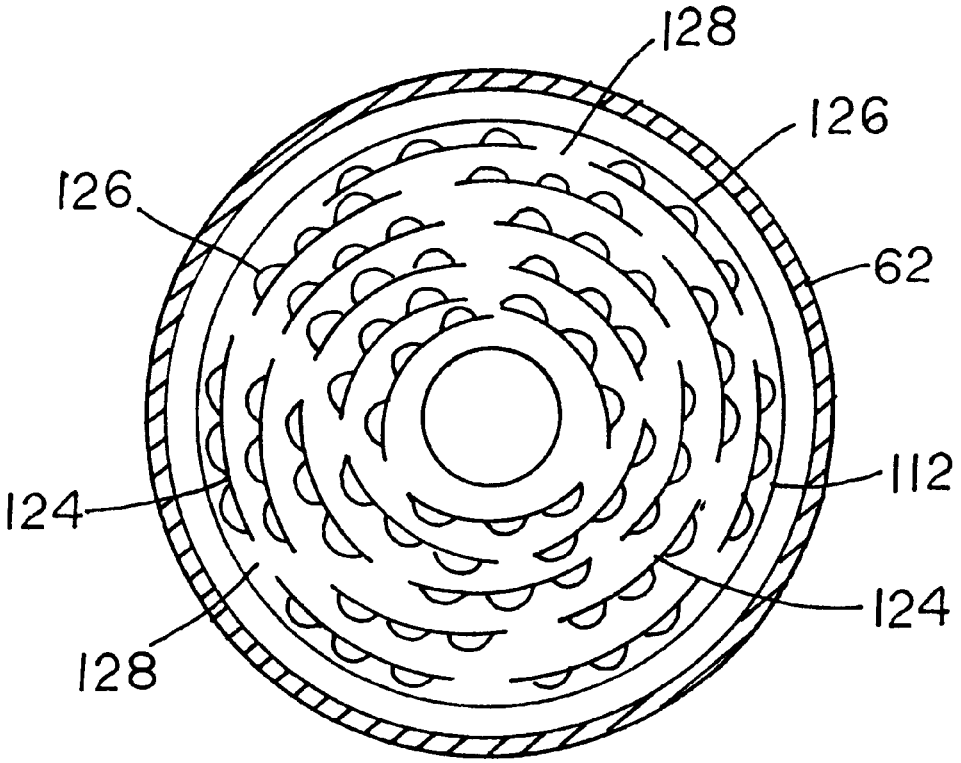
FIG. 3 is a sectional view taken along line 3—3 in FIG. 2.

Referring now to FIGS. 2 and 3, there is shown another embodiment of a centrifugal filter assembly 60 of the present invention. For purposes of illustration, centrifugal filter assembly 60 will be described for use with an internal combustion engine, but it is to be understood that filter assembly 60 may be utilized for other applications.

Housing 62 is attached to an engine (not shown) utilizing flanges 64 and bolts 66. A bottom cover 68 is threadingly engaged with housing 62 and is sealed with housing 62 using an annular O-ring 70. Bottom cover 68 may be removed from housing 62 to allow replacement of filter 72, as will be described in greater detail hereinafter.

Turbine 74 is rotatably carried by housing 62 using one or more reduced friction bearings, such as ball bearing assemblies 76 and 78. Turbine 74 includes a plurality of blades 80 disposed around the periphery thereof. Blades 80 extend generally radially relative to an axis of rotation 82, and have a selected shape to provide a desired rotational speed of turbine 74. The shape of blades 80 and the distance from axis of rotation 82 both have an effect on the rotational speed and are determined for a particular application (e.g., empirically).

A top cover 84 is fastened to housing 62 using, e.g., bolts 86. Seals such as O-rings 88 provide a fluid tight seal between top cover 84 and housing 62. Top cover 84 includes suitable porting 90 and 92 to be fluidly connected with a source of pressurized fluid and the fluid to be filtered, respectively. In the embodiment shown, porting 90 and 92 are each connected with a source of pressurized engine oil which provides both the source of pressurized fluid for rotating turbine 74 and the fluid to be filtered.

Nozzles 94 are attached to and carried by top cover 84, and direct a source of pressurized fluid at selected locations against blades 80 of turbine 74. As viewed in FIG. 2, the left hand nozzle 94 is disposed behind central supply tube 96 and the right hand nozzle 94 is disposed in front of supply tube 96. Nozzles 94 thus both jet a pressurized fluid which impinges upon blades 80 of turbine 94 on opposite sides of turbine 74. Because nozzles 74 are carried by top cover 84 and directed generally inwardly relative to axis of rotation 82, the specific impingement angle of the pressurized fluid on blades 80 can easily be adjusted for a specific application. The angle of impingement, flow velocity of the pressurized fluid, shape of blades 80 and impingement location relative to axis of rotation 82 may be configured to provide a desired rotational speed of turbine 74.

Drive nut 98 includes internal threads which are threadingly engaged with external threads of turbine 74. Drive nut 98 includes an upper, angled surface 100 defining a fluid port for providing lubricating oil to bearings 76 and 78. Drive nut 98 includes a lower drive portion 102 with a cross sectional shape which is other than circular (e.g., hexagonal). The shape of lower drive portion 102 allows turbine 74 to interconnect with filter 72 and rotatably drive filter 72 during use. A flange 104 extends from drive portion 102 and seals with filter 72 around the outer periphery thereof with a slight compression fit.

Splash shield 106 is attached with housing 62 and directs oil away from filter 72 which is used to drive turbine 74. Splash shield 106 is press fit into housing 62 in the embodiment shown. Pressurized fluid in the form of oil which is used to drive turbine 74 falls via gravitational force and flows through holes 108 and into a trough 110 defined by splash shield 106. The trough 110 is connected with an exit port (not shown) in housing 62 for recirculating the fluid to the sump of the engine.

Filter 72 generally includes a body 112, end cap 114 and impingement media 116. Body 112 includes a top opening 118 which surrounds and frictionally engages flange 104 of drive nut 98. The press fit between flange 104 and top opening 118 is sufficient to prevent fluid leakage therebetween. Body 112 also includes a plurality of exit holes, such as the two exit holes 120 in the top thereof. Exit holes 120 allow filtered oil to flow therethrough and into trough 110 during operation after filter 72 is full of the oil to be filtered.

End cap 114 is attached with body 112 in a suitable manner. In the embodiment shown, end cap 114 and body 112 are each formed from plastic and are ultrasonically welded together. However, it is also possible to attach end cap 114 with body 112 in a different manner, such as through a threaded or snap lock engagement. End cap 114 includes an upwardly projecting stud 122 with an angled distal face which acts to radially distribute oil to be filtered which is ejected from central supply tube 96.

Impingement media 116, shown in more detail in FIG. 3, is in the form of a long, continuous sheet 124 of material which is wrapped in a spiral manner about supply tube 96 and stud 122. Sheet 124 is formed with a plurality of randomly located dimples 126 which are approximately 3/16 inch diameter and 0.070 inch deep. Each dimple 126 defines a generally concave surface facing toward axis of rotation 82. Sheet 124 is approximately 0.020 inch thick and includes a plurality of holes 128 between dimples 126 which have a diameter of approximately 0.060 inch. Holes 128 are also substantially randomly placed on sheet 124 at locations between dimples 126 at a ratio of approximately one hole per every three dimples. In the embodiment shown, dimples 126 have a center-to-center distance which varies, but with a mean center-to-center distance of approximately 5/8 inch. Of course, it will be appreciated that the specific geometry and number of dimples 126 and/or holes 128 within sheet 124 may vary depending upon the specific application.

Impingement media 116 in the form of a spiral wrapped sheet with dimples 126 and holes 128 provides effective centrifugal separation of particulates within the oil, and also regulates the residence time of the oil within filter 72. As filter 72 rotates at a desired rotational speed during use, the oil to be filtered is biased radially outwardly against an adjacent portion of sheet 124. Particulates within the oil settle into the concave surfaces defined by dimples 126 and the filtered oil migrates toward a hole 128 to pass therethrough in a radial direction and impinge upon the next radially outward portion of sheet 124. The radially outward flow of the oil through holes 128 in sheet 124 and trapping of particulates within dimples 126 continues until the filtered oil lies against the inside diameter of body 112. An annular cap 130 at the end of spiral wrapped sheet 124 prevents the oil from prematurely exiting in an axial direction toward the end of filter 72. The filtered oil flows in an upward direction along the inside diameter of body 112 and through exit holes 120 into trough 110 to be transported back to the sump of the engine.

Figure 4:
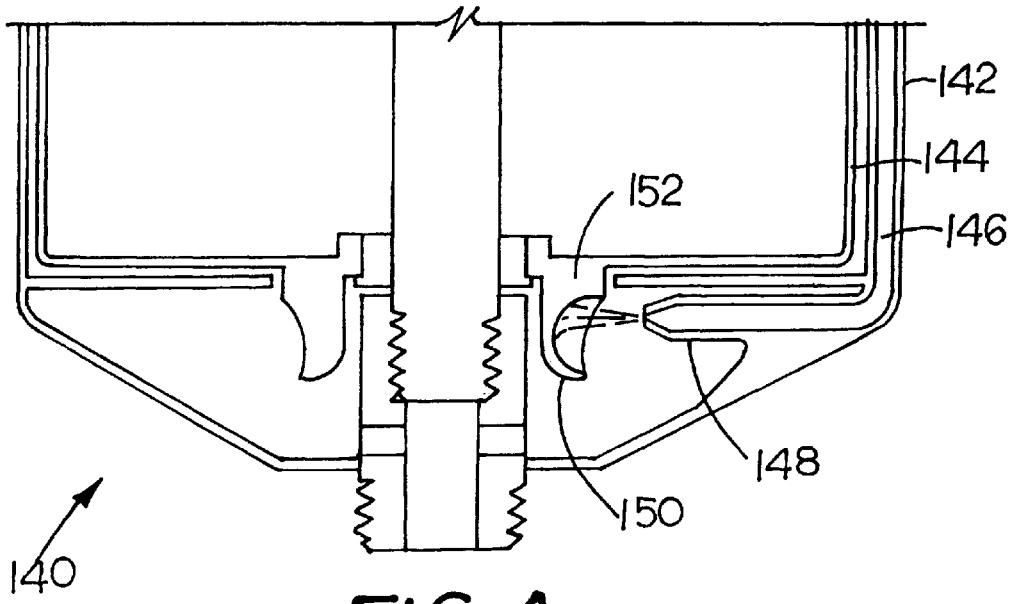
FIG. 4 is a fragmentary, side view of still another embodiment of a centrifugal filter assembly of the present invention.

FIG. 4 illustrates yet another embodiment of a centrifugal filter assembly 140 of the present invention. Filter assembly 140 includes a housing 142 with a filter 144 rotatably disposed therein. Housing 142 includes an integral fluid channel 146 which terminates at a nozzle 148. Nozzle 148 directs pressurized fluid against turbine blades 150 of turbine 152.

Filter 144 includes turbine 152 as an integral part thereof. That is, turbine 152 is monolithically formed with filter 144. In the embodiment shown, filter 144 and turbine 152 are each formed at the same time using a plastic injection molding process.

Figure 5:
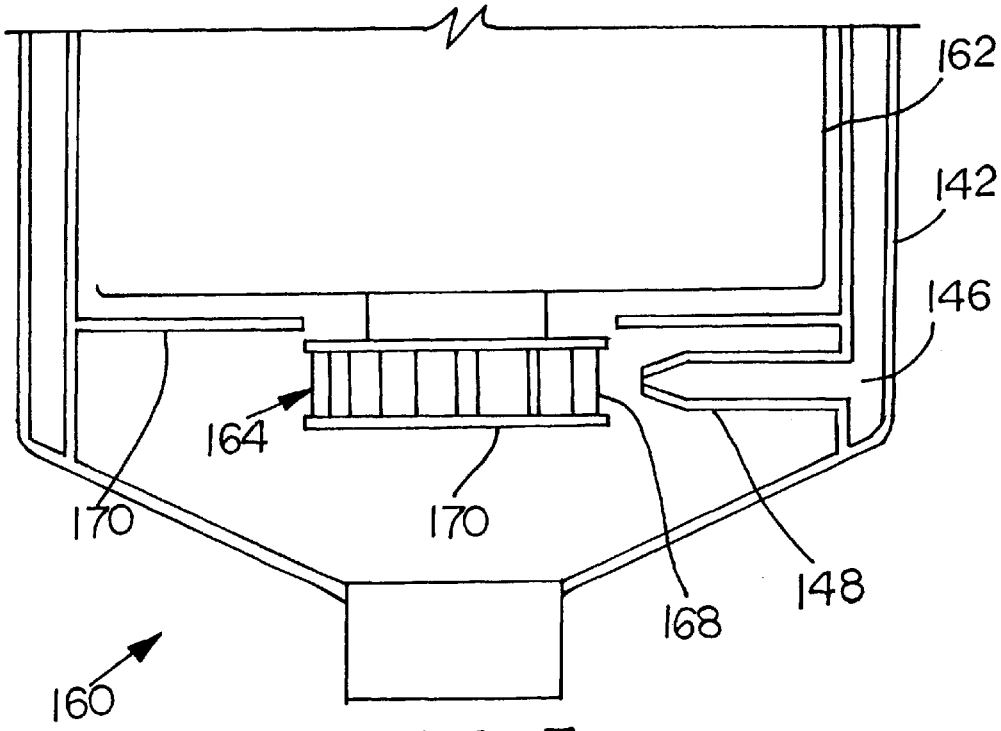
FIG. 5 is a fragmentary, side view of another embodiment of a centrifugal filter assembly of the present invention.

Referring now to FIG. 5, another embodiment of a centrifugal filter assembly 160 is shown, including a housing 142 and filter 162. Filter 162 includes a turbine 164 with a plurality of turbine blades 168. Turbine 164 includes a deflector shield 170 attached to an axial end thereof which maximizes the efficiency of the pressurized fluid jetted from nozzle 148 by confining sideways deflection of the fluid impinging on blades 168.

Figure 6:
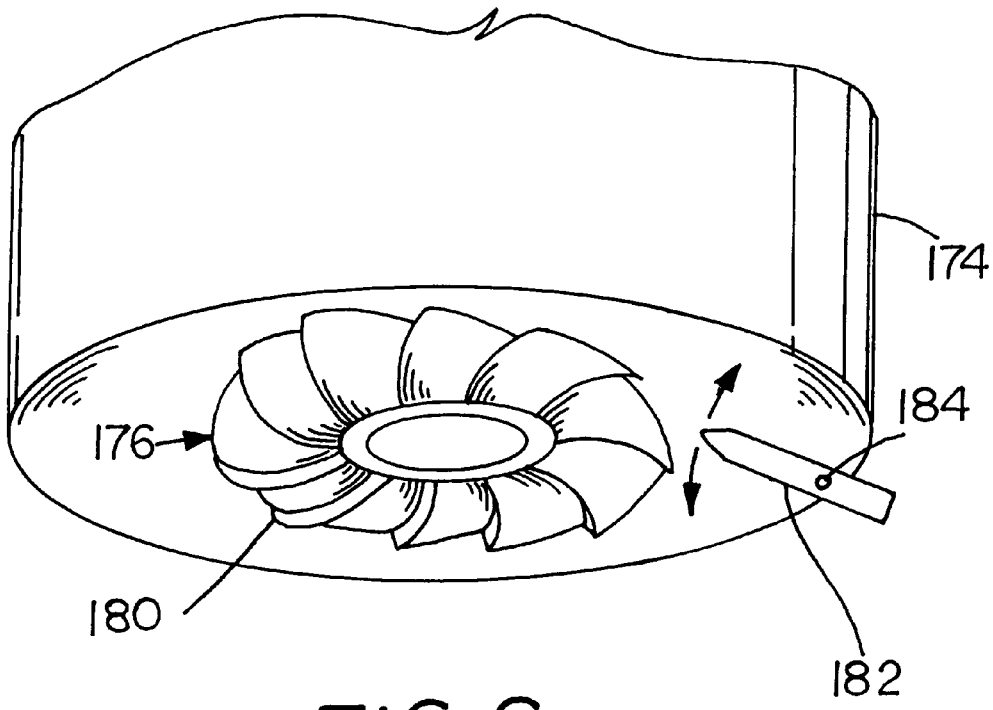
FIG. 6 is a perspective view of an embodiment of a filter of the present invention.

FIG. 6 illustrates another embodiment of a filter 174 which may be utilized with the centrifugal filter assembly of the present invention. Filter 174 includes a turbine 176 with a plurality of variable pitch turbine blades 180. A nozzle 182 which is attached with and pivotable relative to a housing (not shown) about a pivot point 184 is adjustable during use to change the impingement angle on blades 180 and the distance from the axis of rotation. The composite curved shape of each blade 180 coacts with the variable impingement angle from nozzle 182 to vary the rotational speed of and/or torque applied to turbine 176.

Figure 7:
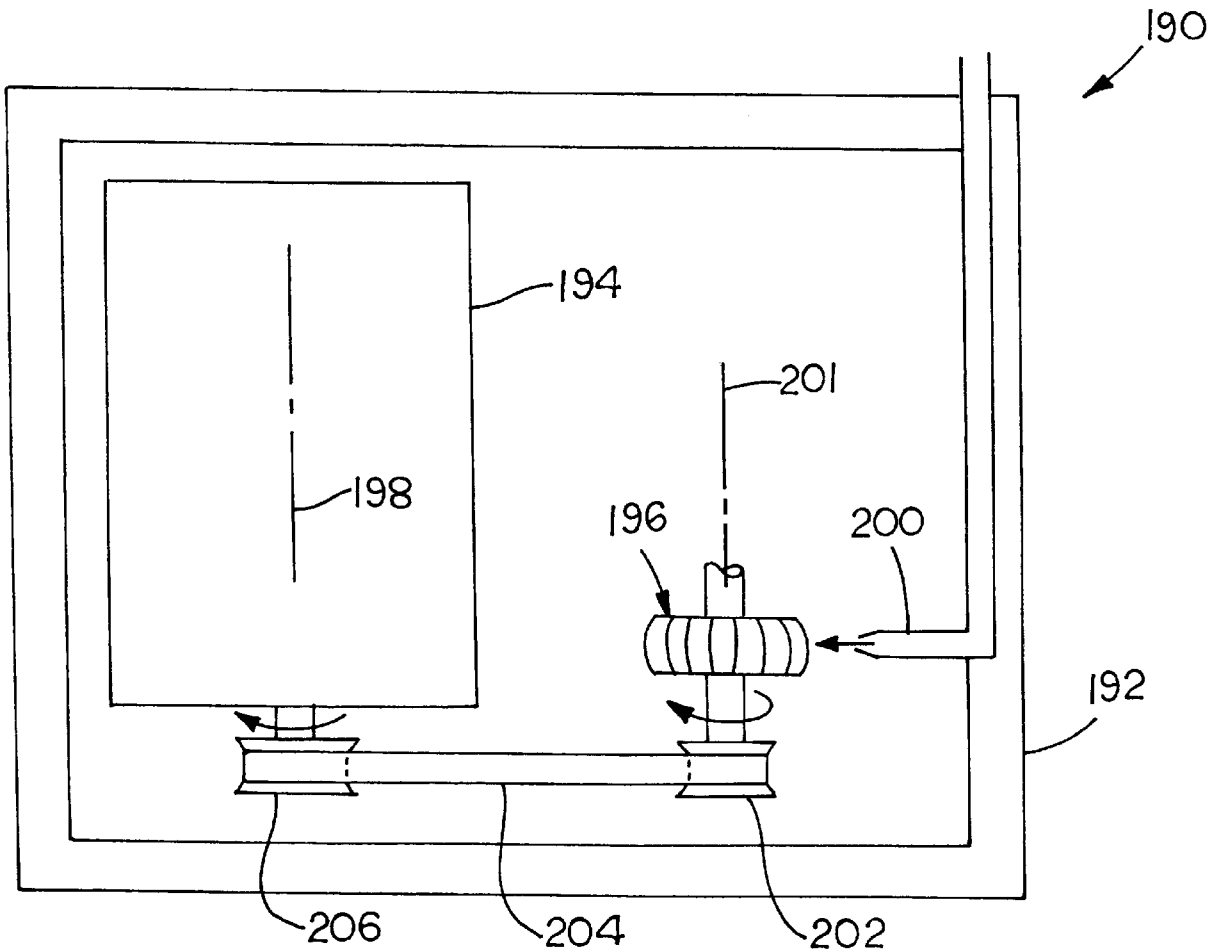
FIG. 7 is a simplified, side view of still another embodiment of a centrifugal filter assembly of the present invention.
Figure 8:
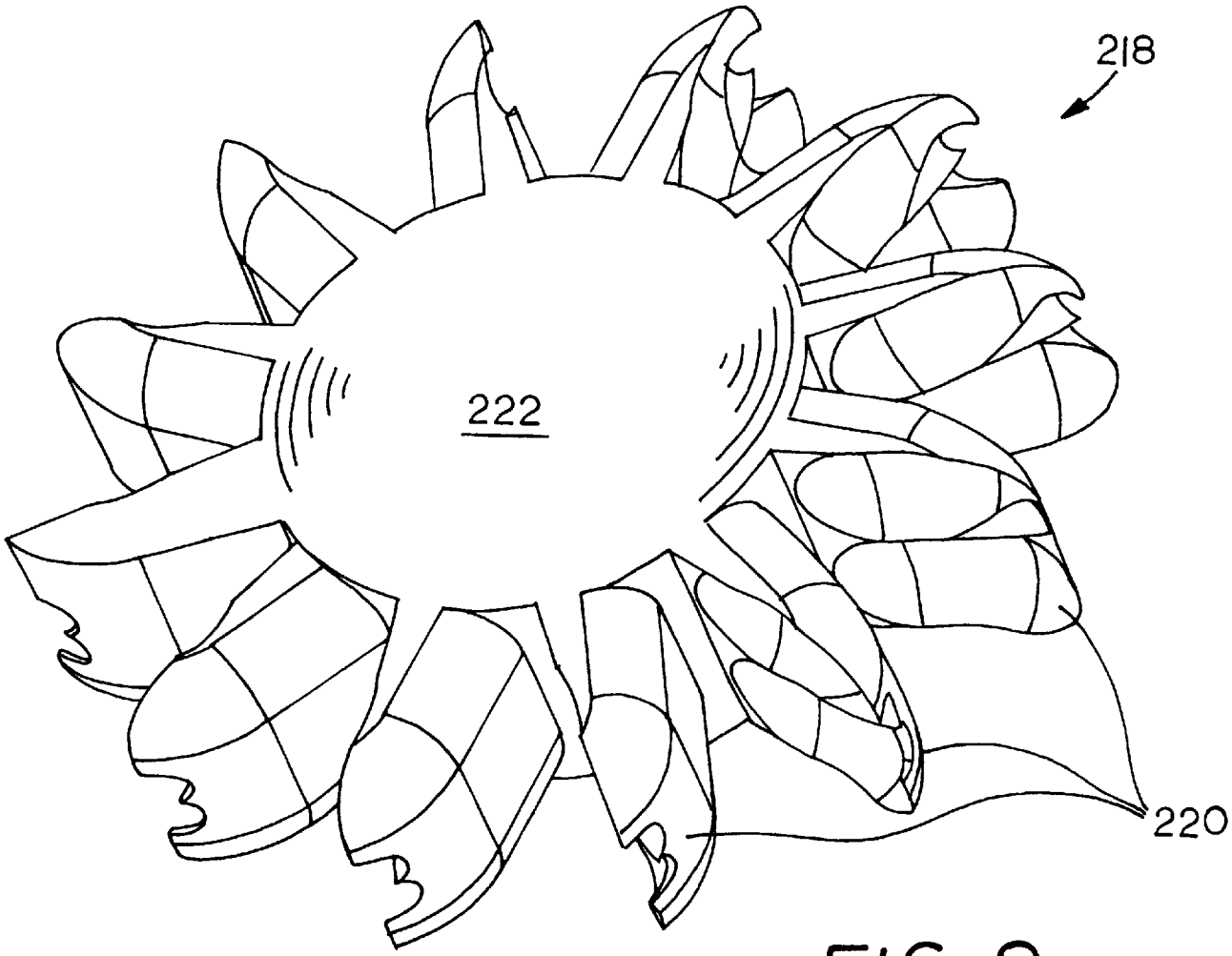
FIG. 8 is a perspective view of an embodiment of a turbine for use with the centrifugal filter assembly of the present invention.
Figure 9:
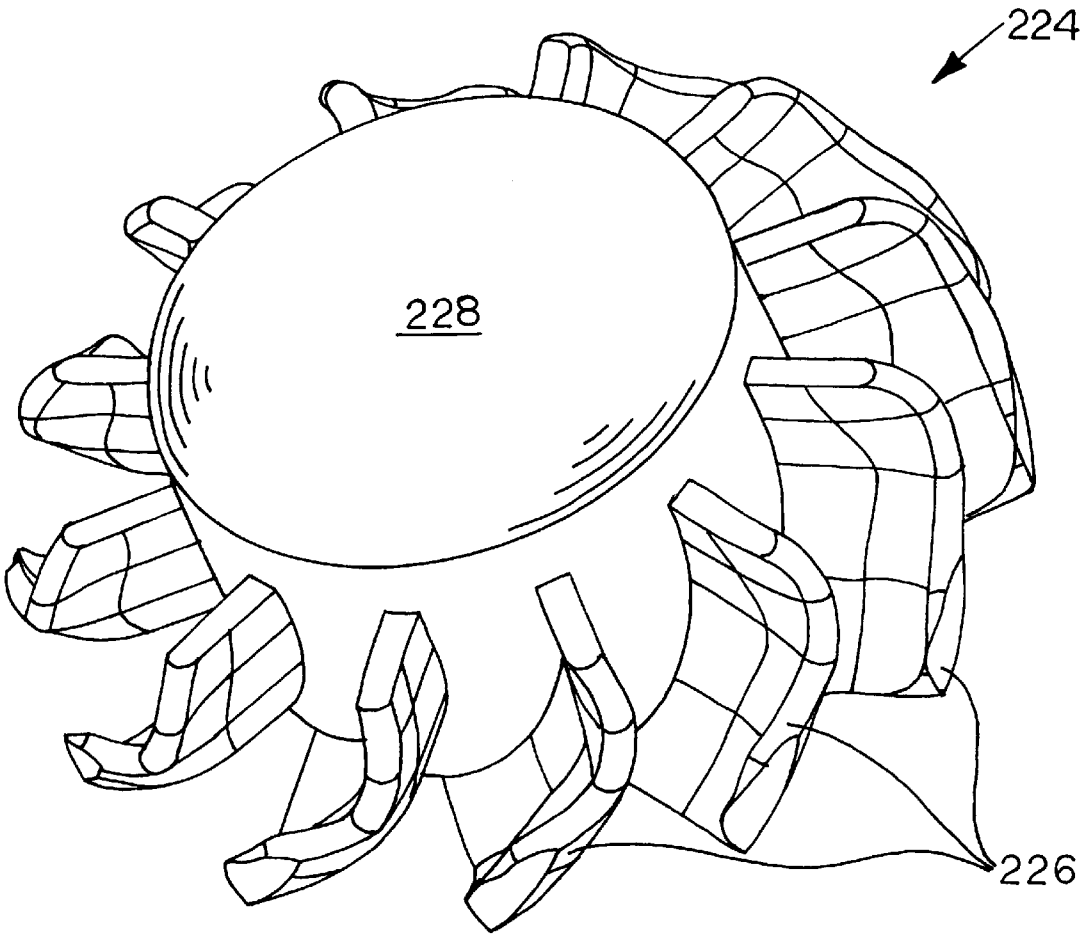
FIG. 9 is a perspective view of another embodiment of a turbine for use with the centrifugal filter assembly of the present invention.
Figure 10:
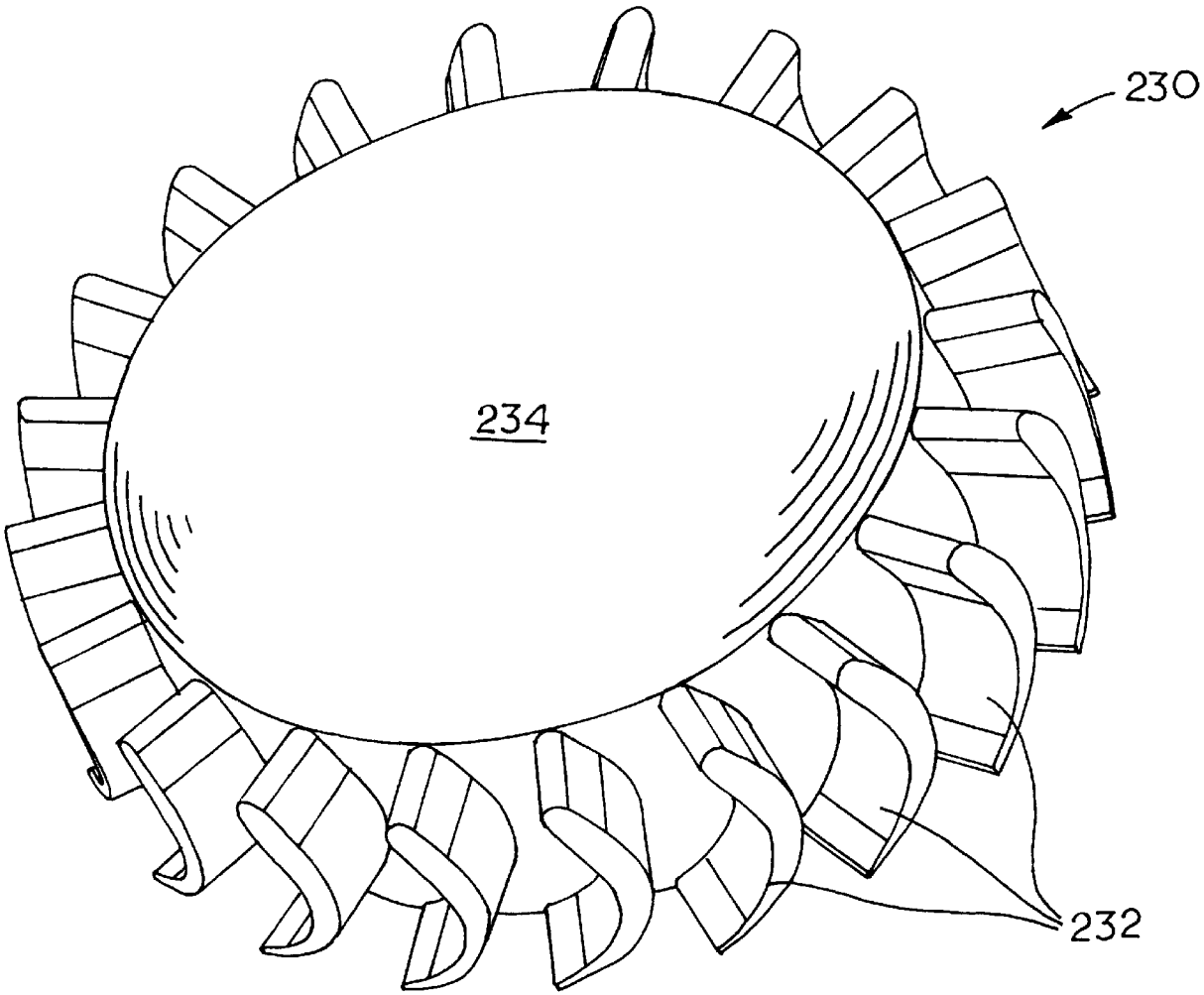
FIG. 10 is a perspective view of yet another embodiment of a turbine for use with the centrifugal filter assembly of the present invention.
Figure 11:
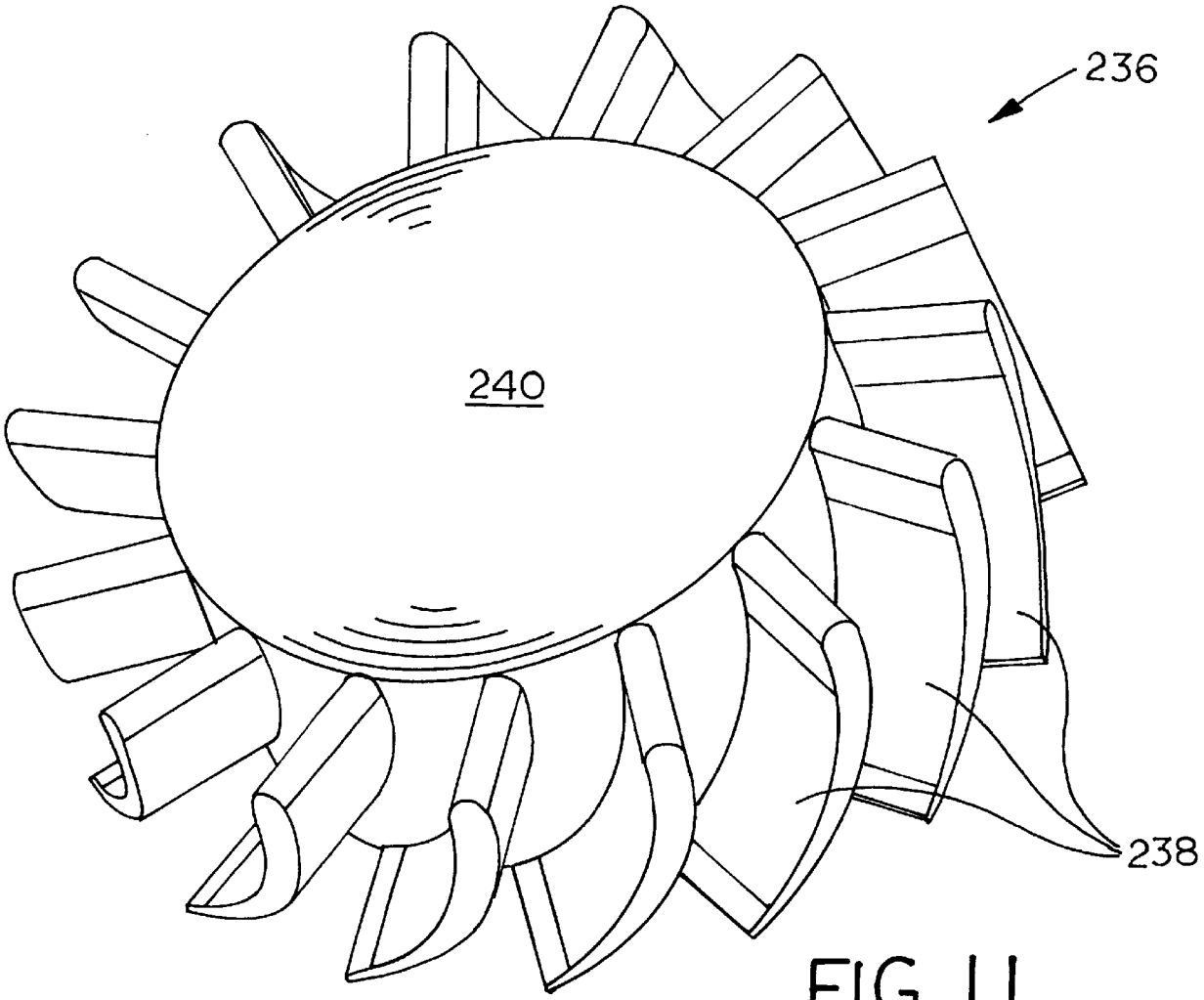
FIG. 11 is a perspective view of still another embodiment of a turbine for use with the centrifugal filter assembly of the present invention.

FIG. 7 illustrates yet another embodiment of a centrifugal filter assembly 190 of the present invention. Filter assembly 190 generally includes a housing 192, filter 194 and turbine 196. Filter 194 and turbine 196 are each disposed within housing 192 and are carried by suitable support structure (not shown) allowing rotation around respective axes of rotation 198 and 201. A nozzle 200 defined by housing 192 jets a flow of pressurized fluid onto turbine 196 to cause rotation thereof about axis of rotation 201. Rotation of turbine 196 in turn rotates pulley 202 which is connected via drive belt 204 with a pulley 206 rigidly attached to filter 194. Thus, rotation of turbine 196 causes rotation of filter 194 about axis of rotation 198. Using an elongate force transmission element, such as drive belt 204, allows the rotational speed of filter 194 to not only be adjusted by changing the physical configuration of turbine 196, but also by changing the diameters of the drive pulley 202 and driven pulley 206. For example, providing drive pulley 202 with a diameter which is the same as turbine 196 but twice as large as driven pulley 206 provides filter 194 with a rotational speed which is twice that of turbine 196.

Figure 12:
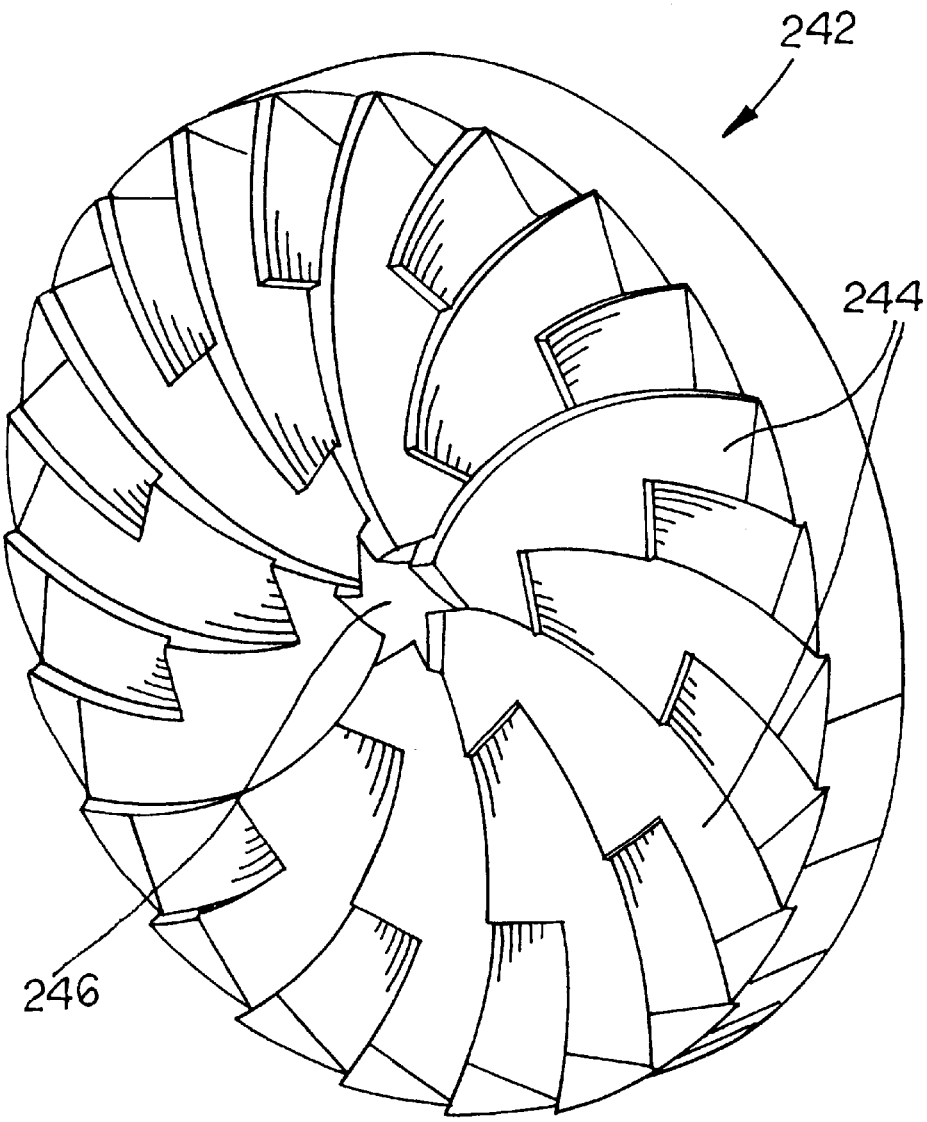
FIG. 12 is a perspective view of a further embodiment of a variable geometry turbine for use with the centrifugal filter assembly of the present invention.

FIGS. 8–12 illustrate perspective views of alternative embodiments of turbines which may be used in a centrifugal filter assembly of the present invention. The turbines shown in FIGS. 8–11 are fixed blade designs for use with a stationary nozzle, while the turbine shown in FIG. 12 is a variable geometry design for use with an adjustable nozzle. Turbine 218 (FIG. 8) includes a plurality of turbine blades 220 extending radially from a hub 222. Turbine 224 (FIG. 9) includes a plurality of turbine blades 226 extending radially from a hub 228. Turbine 230 (FIG. 10) includes a plurality of turbine blades 232 extending radially from a hub 234. Turbine 236 (FIG. 11) includes a plurality of turbine blades 238 extending radially from a hub 240. Lastly, Turbine 242 (FIG. 12) includes a plurality of turbine blades 244 extending radially from a hub 246.

Figure 13:
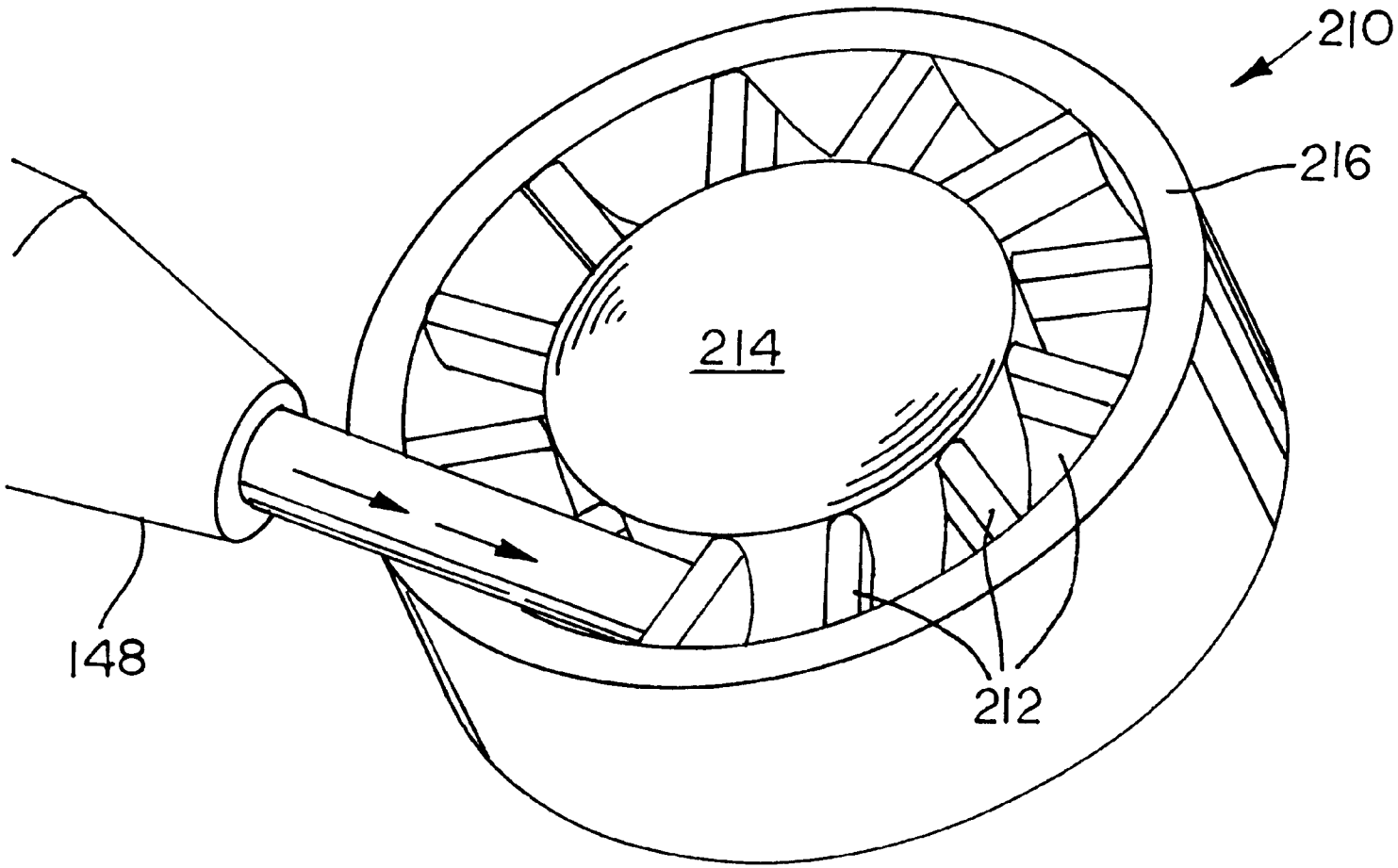
FIG. 13 is a perspective view of yet another embodiment of a turbine for use with the centrifugal filter assembly of the present invention.

FIG. 13 is a perspective view of yet another embodiment of a turbine 210 which may be utilized with a centrifugal filter assembly of the present invention. Turbine 210 includes a plurality of turbine blades 212 extending radially from a hub 214. A deflector shield 216 surrounds the periphery of turbine 210 and contacts blades 212. For example, deflector shield 216 may be press fit onto turbine 210 around the periphery of blades 212. Deflector shield 216 maximizes the efficiency of the pressurized fluid which is jetted from a nozzle 148 by confining radial deflections of the fluid impinging on blades 212.

Figure 14:
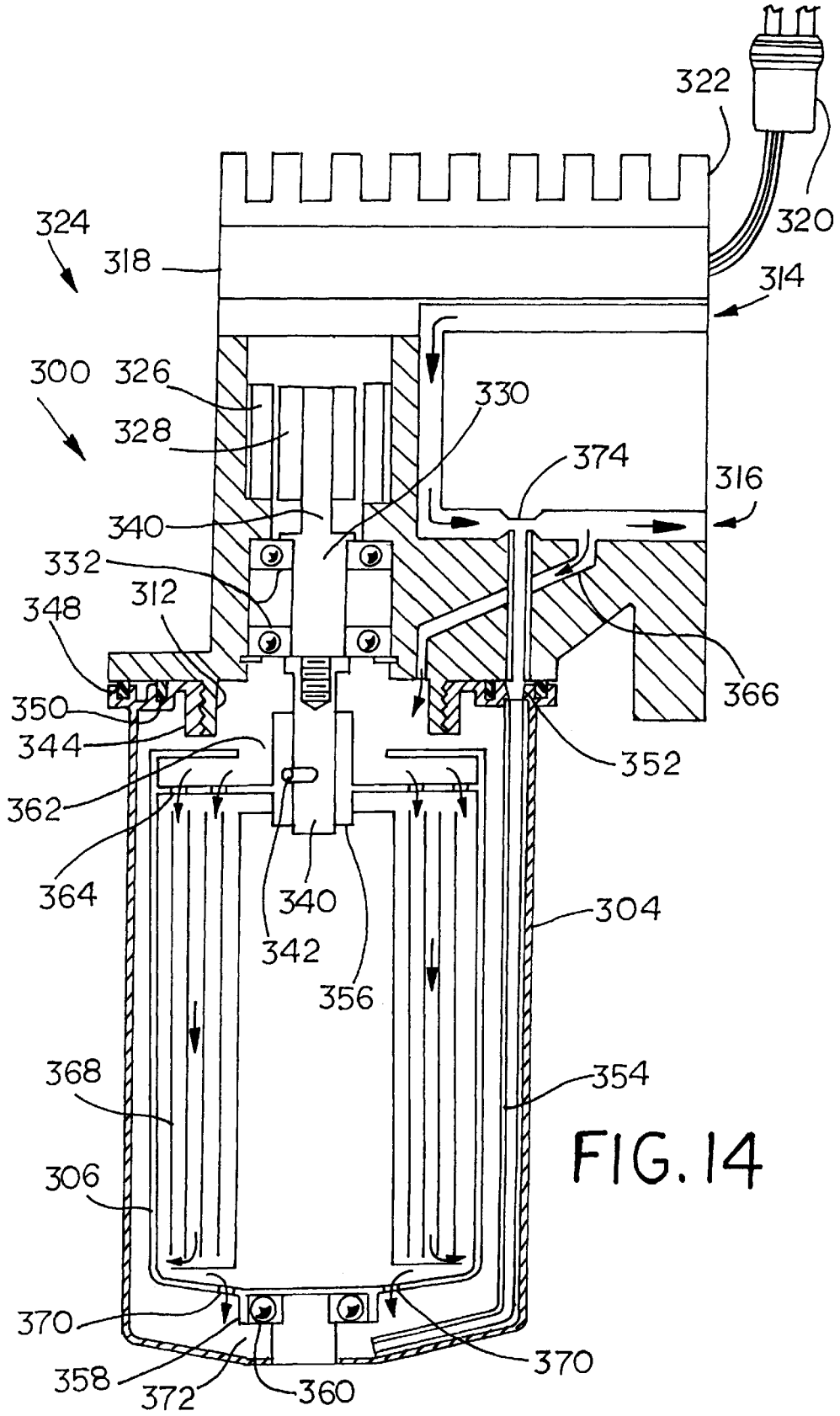
FIG. 14 is a side sectional view of another embodiment of a centrifugal filter assembly of the present invention.
Figure 15:
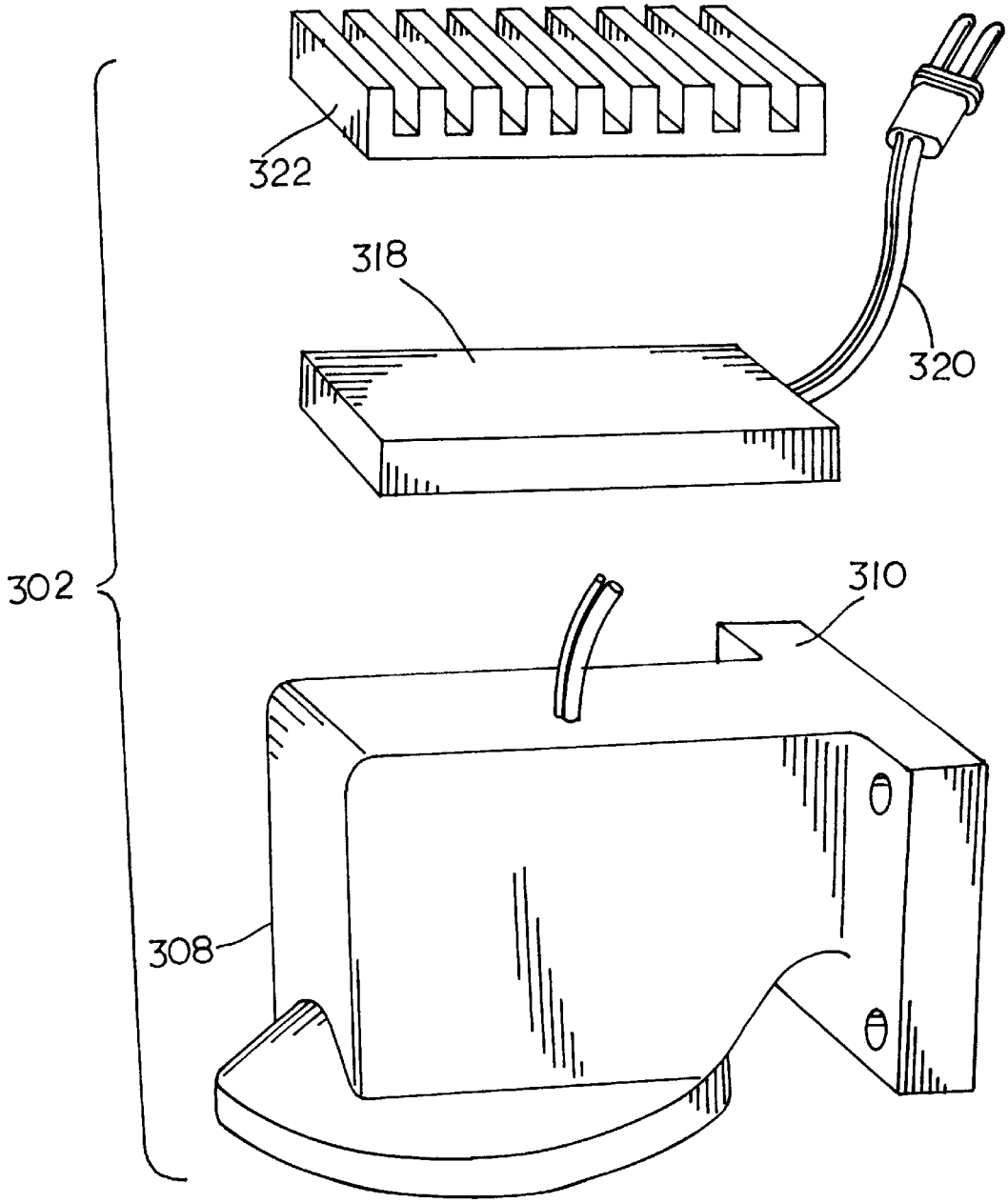
FIG. 15 is an exploded, perspective view of the filter head of FIG. 14.
Figure 16:
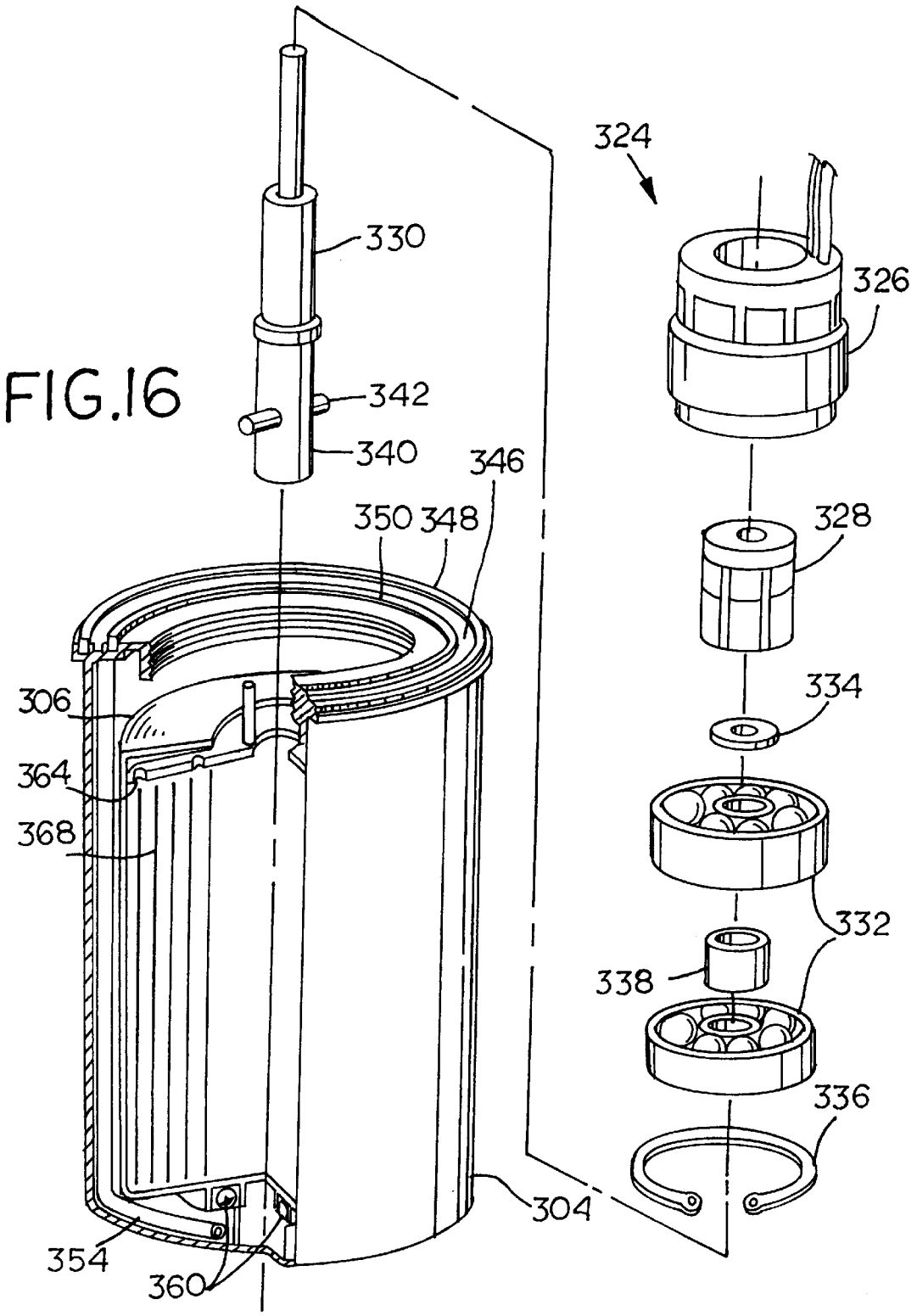
FIG. 16 is an exploded, partially sectioned view of the centrifugal filter assembly of FIGS. 14 and 15.

FIGS. 14–16 conjunctively illustrate another embodiment of centrifugal filter assembly 300 of the present invention, including a filter head 302, housing 304 and rotatable filter 306.

Filter head 302 includes a body 308 with a mounting flange 310 configured for connection with a source of oil to be filtered, such as an internal combustion engine. Body 308 includes a first threaded connector 312 for connection with housing 304, as will be described in more detail hereinafter. An inlet 314 receives oil from the internal combustion engine (not shown) and an outlet 316 returns oil to the internal combustion engine. In the embodiment shown, inlet 314 receives engine oil from an oil gallery which is pressurized to the rifle pressure within the oil gallery.

A controller 318 is connected to body 308 and controls operation of a DC brushless motor, as will be described hereinafter. Controller 318 may include a plugable cord 320 for attachment with a source of direct current power, such as an electrical system associated with the internal combustion engine. A heat sink 322 is attached to controller 318 for dissipating heat to the ambient environment. Heat sink 322 may be of any suitable configuration.

Filter head 302 also includes a brushless DC motor 324 which is carried by and disposed within body 308. DC motor 324 includes a brushless motor coil 326, a rotor 328 and an output shaft 330. Motor coil 326 is carried within a corresponding recess formed in body 308. Rotor 328 is press fit onto output shaft 330. Energization of motor coil 326 causes rotor 328 to rotate in known manner, which in turn causes output shaft 330 to rotate. Output shaft 330 may be carried by a pair of reduced friction bearings 332 disposed within body 308. Bearings 332 are located within body 308 using a bearing retainer 334 and a snap ring 336. A spacer 338 may be interposed between bearings 332 to maintain a proper axial spacing therebetween. Output shaft 330 includes a distal end defining a drive element in the form of a drive shaft 340 which is used to rotatably drive filter 306, as will be described in more detail hereinafter. Drive shaft 340 may include a drive pin 342 extending transversely therethrough which engages and drives filter 306.

Housing 304 is connected to filter head 302 in a suitable manner. In the embodiment shown, housing 304 includes a second threaded connector 344 which threadingly engages with first connector 312, and thereby attaches housing 304 with body 308. The threaded interconnection between first connector 312 and second connector 344 allows housing 304 to be attached with filter head 302 in a spin-on manner, thereby allowing easy removal and replacement of filter 306. Housing 304 may be connected to filter head 302 in other suitable ways, such as using a bolted flange, an annular V-shaped clamp surrounding adjacent flanges, an axial bolt, etc.

Housing 304 includes an open end 346, at which are disposed a pair of annular seals 348 and 350. An annular groove 352 is disposed between first annular seal 348 and second annular seal 350 at open end 346. A drain tube 354 disposed within and carried by housing 304 includes an open end which is disposed in communication with groove 352. An opposite open end of drain tube 354 is disposed in a bottom of housing 304. When housing 304 is connected with body 308, annular groove 352 is connected and disposed in communication with outlet 316 within body 308. Accordingly, drain tube 354 is also in communication with outlet 316 in body 308.

Filter 306 includes a hub 356 which engages with and is rotated by drive shaft 340. A hub 358 disposed at an opposite end from hub 356 allows filter 306 to be carried by a reduced friction bearing 360 at an end opposite from drive shaft 340. Filter 306 includes a major inlet 362 which is in the form of an annular opening surrounding hub 356. Filter 306 also includes a plurality of minor inlets 364. Each of major inlet 362 and minor inlets 364 are in communication with and receive oil to be filtered from a feed line 366 in filter head 302. Feed line 366 receives pressurized oil to be filtered, as will be described in more detail hereinafter.

Filter 306 also includes filter media 368 disposed therein which allows soot within the engine oil to be effectively filtered therefrom during rotation of filter 306. A plurality of outlets in the form of holes 370 formed in filter 306 allow the filtered oil to be drained from filter 306. The filtered oil collects in a sump area 372 where it is removed by the vacuum pressure created within drain tube 354.

During use, pressurized oil is transported through inlet 314 in body 308 of filter head 302. The pressurized oil flows to a venturi section 374 where the velocity of the oil increases and the pressure decreases. The reduced pressure caused by venturi section 374 creates a vacuum within sump 372 and drain tube 354 which allows the filtered oil within sump 372 to be drawn into the area of venturi section 374. As the oil flows past venturi section 374, the pressure again increases within outlet 316 in body 308. Pressurized oil is thus transported through a feed line 366 to major inlet 362 and minor inlets 364 of filter 306. The oil to be filtered flows through filter media 368. Brushless DC motor 324 rotates drive shaft 340 at a known rotational speed, which in turn rotates filter 306 within housing 304. The rotational speed of DC motor 324 is controlled using controller 318. The rotational speed of DC motor 324 is sufficient to filter soot from the engine oil flowing past media 368. The filtered oil flows through filter outlets 370 into sump 372. The filtered oil is then drawn through drain tube 354 to venturi section 374. The portion of the oil flowing past venturi section 374 which does not flow through feed line 366 instead flows in a parallel manner through outlet 316 to be returned to a sump in an internal combustion engine.

Figure 17:
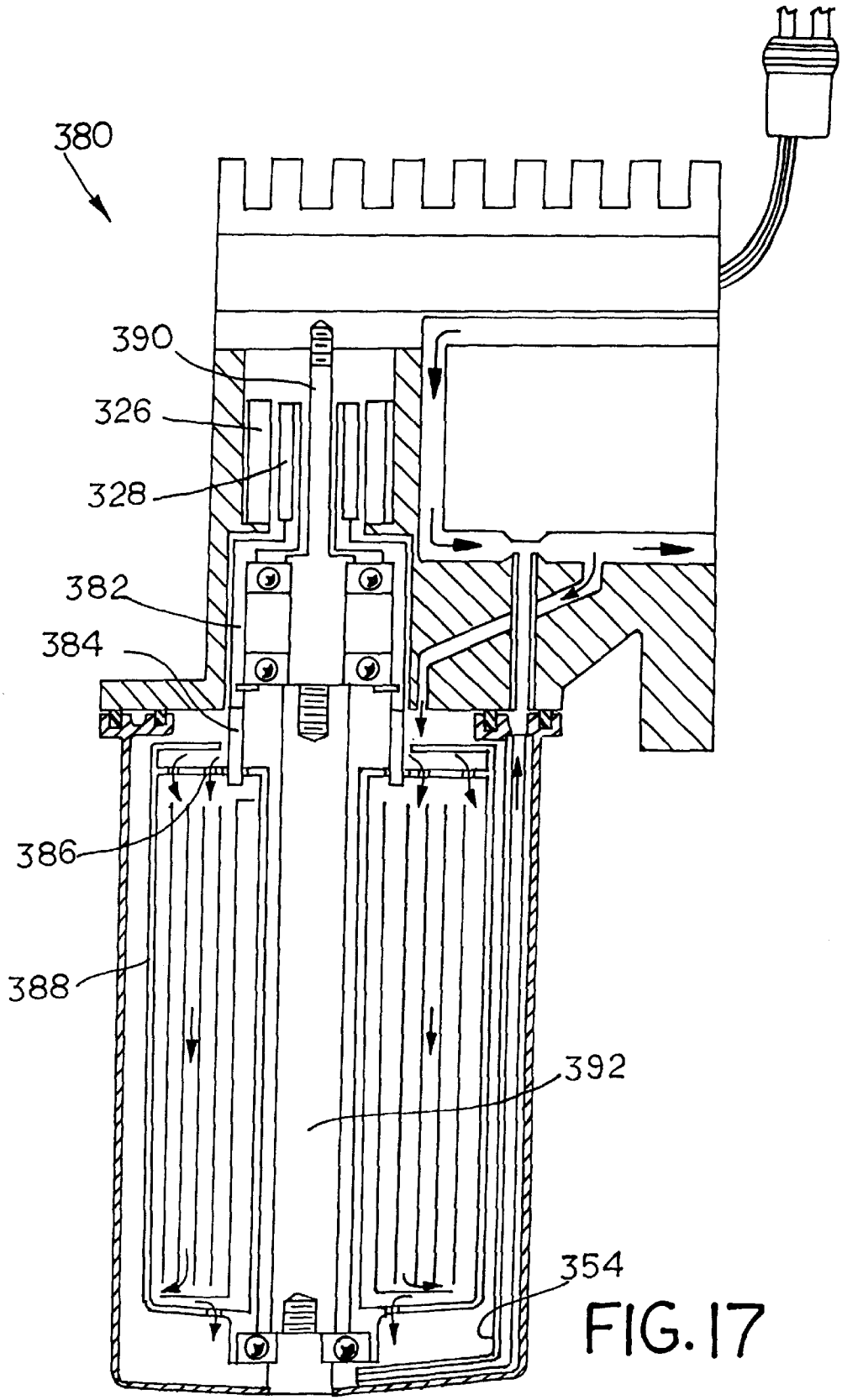
FIG. 17 is a side, sectional view of another embodiment of a centrifugal filter assembly of the present invention.

Referring now to FIG. 17, another embodiment of a centrifugal filter assembly 380 of the present invention is shown. Centrifugal filter assembly 380 principally differs from centrifugal filter assembly 300 in that rotatable drive element 382 is in the form of a drive cylinder driven by rotor 328 of DC motor 324. Drive cylinder 382 includes a plurality of drive projections or tangs 384 which extend into corresponding openings 386 formed in the top of filter 388. A stationary support shaft 390 is threadingly engaged with filter head 302. An opposite end of support shaft 390 is threadingly engaged with a support shaft 392 connected with housing 394.

Figure 18:
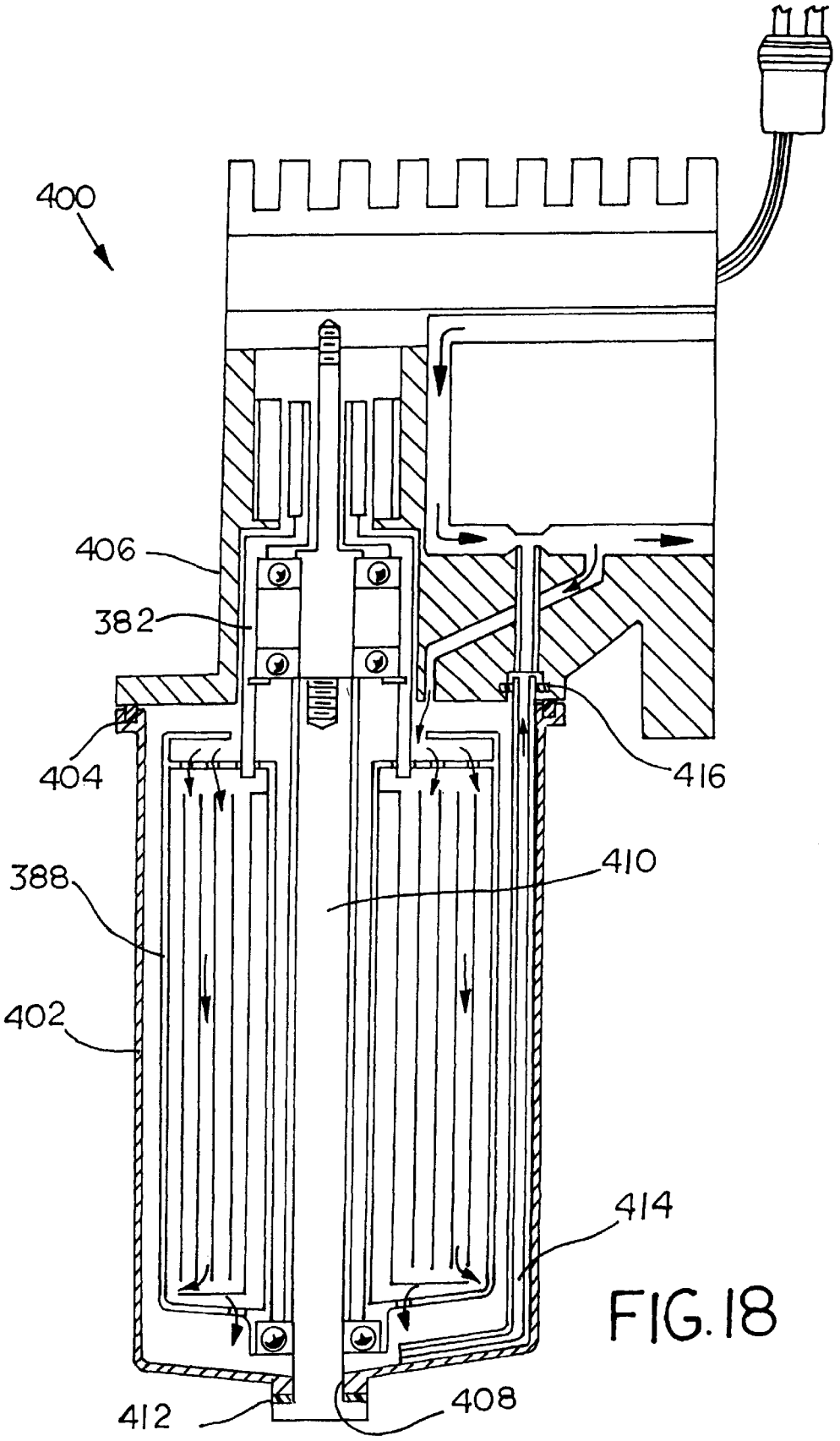
FIG. 18 is a side, sectional view of another embodiment of a centrifugal filter assembly of the present invention.

FIG. 18 illustrates another embodiment of a centrifugal filter assembly 400 of the present invention. Filter assembly 400 includes a drive cylinder 382 which engages a filter 388, similar to the embodiment of centrifugal assembly 380 shown in FIG. 17. However, housing 402 is not configured as a spin-on housing as in the embodiments of FIGS. 14–16 and 17. Rather, housing 402 includes a single annular seal 404 which abuts against filter head 406. An opposite end of housing 402 includes an opening 408 through which a support shaft 410 extends. A seal 412 is interposed between a head of support shaft 410 and housing 402 to seal therebetween. Housing 402 carries a drain tube 414. However, drain tube 414 extends past the sealing surface defined by seal 404. When housing 402 is engaged with filter head 406, drain tube 414 extends into a corresponding opening found in filter head 406. An O-ring 416 seals between drain tube 414 and filter head 406.

Figure 19:
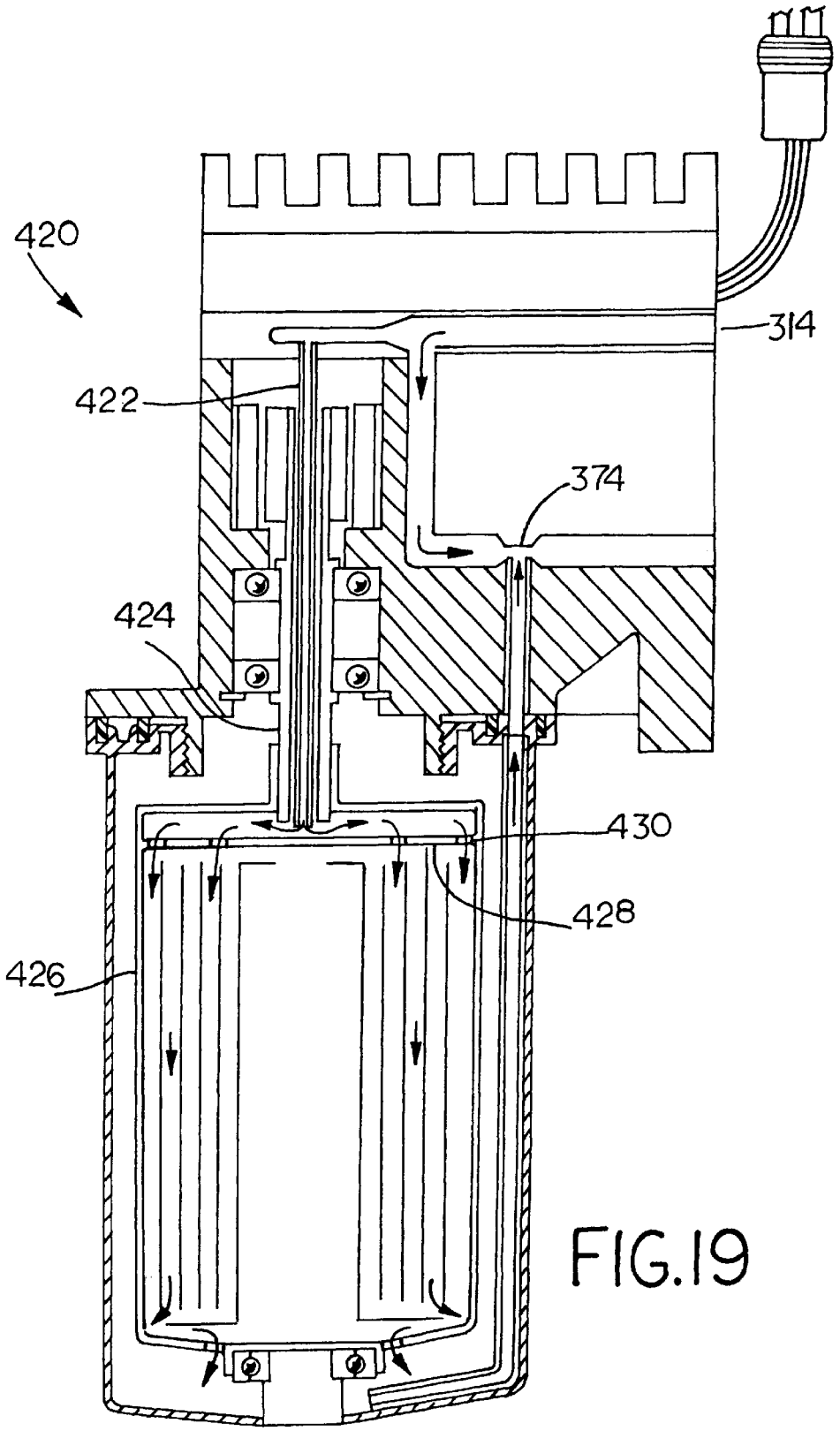
FIG. 19 is a side, sectional view of another embodiment of a centrifugal filter assembly of the present invention.

FIG. 19 illustrates yet another embodiment of a centrifugal filter assembly 420 of the present invention. Filter assembly 420 includes an oil feed line 422 which extends through the center of drive shaft 424. Drive shaft 424 carries and rotatably drives filter 426. Oil to be filtered which is transported through feed line 422 impinges upon a baffle disc 428 in the top of filter 426. Baffle 428 includes a plurality of inlets 430. Inlets 430 are disposed in communication with feed line 422, which in turn is connected with inlet 314 in filter head 432 at the upstream side of venturi section 374. This embodiment has the advantage of not recycling oil which has just been filtered back to inlets 430 of filter 426.

Figure 20:
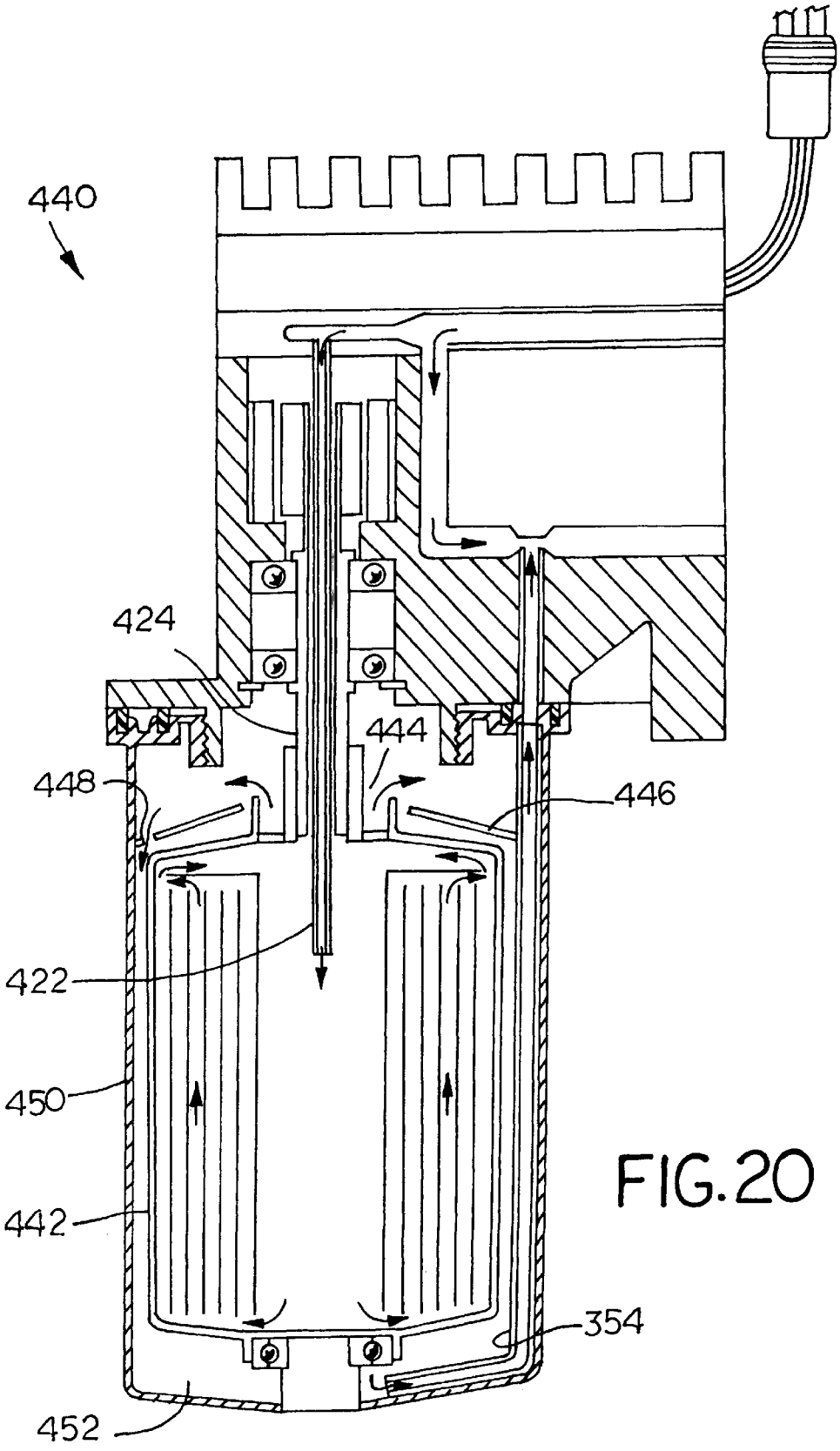
FIG. 20 is a side, sectional view of another embodiment of a centrifugal filter assembly of the present invention.

FIG. 20 illustrates yet another embodiment of a centrifugal filter assembly 440 of the present invention. Filter assembly 440 includes a feed line 422 which extends through the center of drive shaft 424, similar to the embodiment of centrifugal filter assembly 420 shown in FIG. 19. However, the oil is introduced directly into the center portion of filter 442. During rotation of filter 442, the oil is forced in a radially outward and upward direction for filtration of particulates such as soot therein. The oil then flows from a plurality of outlets 444 formed in the top of filter 442. The oil then flows over the top of a splash shield 446 and flows through a plurality of openings 448 adjacent housing 450. The oil then flows by gravitational force to a sump 452 where it is removed via the vacuum pressure created by drain tube 354.

Figure 21:
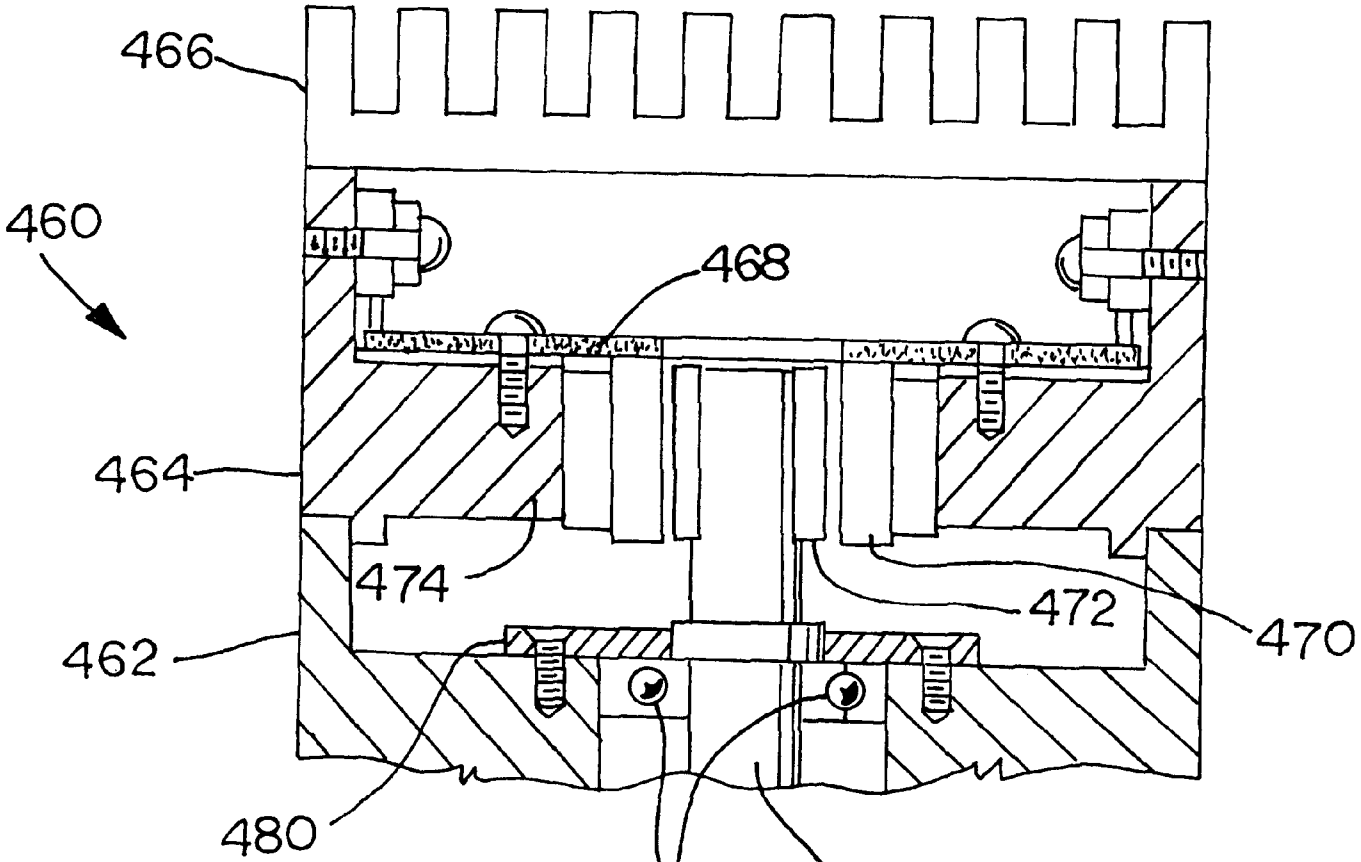
FIG. 21 is a side view of another embodiment of a filter head used with a centrifugal filter assembly of the present invention.

FIG. 21 illustrates a portion of a filter head 460 which may be used in a centrifugal filter assembly of the present invention. It will be appreciated that any of the embodiments of the centrifugal filter assembly shown in FIGS. 14–20 may be adapted to utilize filter head 460. Filter head 460 includes a body 462 which is attached to a controller 464. Controller 464 in turn is attached to a heat sink 466 for dissipating heat to an ambient environment. Controller 464 includes a printed circuit board 468 with suitable electronic circuitry which is necessary to control the rotational speed of a brushless DC motor including brushless motor coil 470 and rotor 472. Controller 464 includes a radially inwardly extending projection 474 which supports both printed circuit board 468 and brushless motor coil 470. Motor coil 470 and printed circuit board 468 are thus connected together via radially inwardly extending portion 474. Rotor 472 is carried by drive shaft 476, which in turn is supported by reduced friction bearing 478. A retainer disc 480 retains bearing 478 in place.

Figure 22:
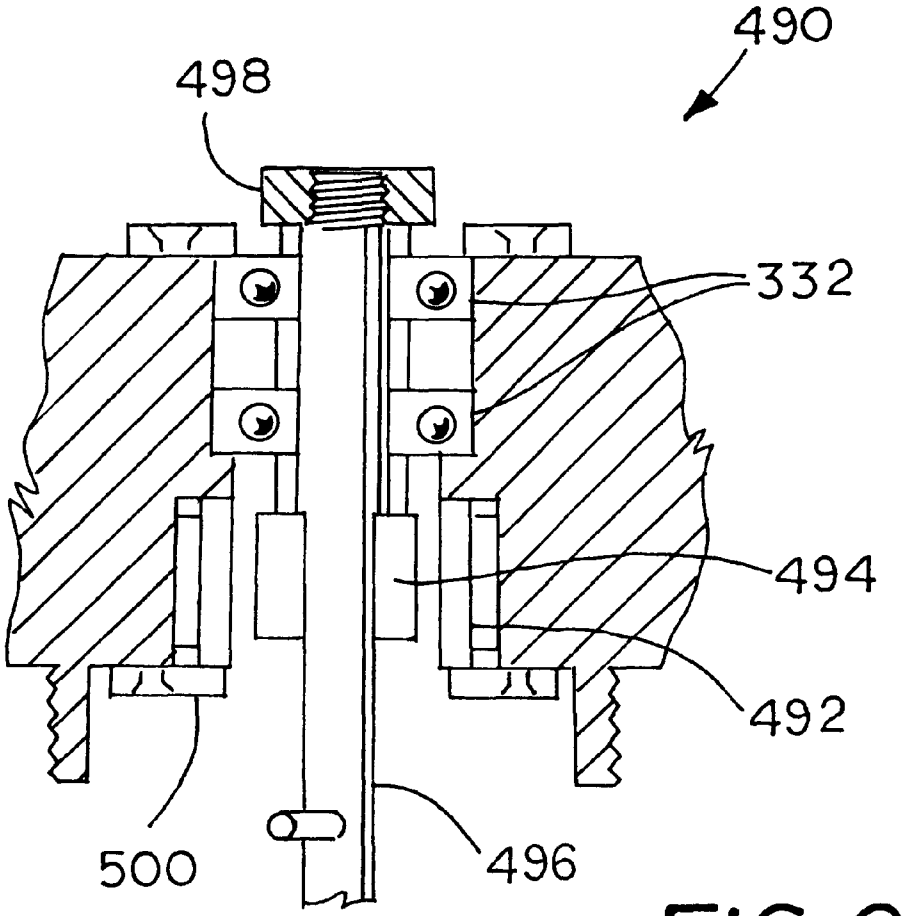
FIG. 22 is a side view of a portion of a filter head used in another embodiment of a centrifugal filter assembly of the present invention.

FIG. 22 illustrates a portion of another embodiment of a filter head 490 which may be used with a centrifugal filter assembly of the present invention. Filter head 490 includes a brushless DC motor with a motor coil 492 and a rotor 494 which are disposed adjacent to drive shaft 496. That is, motor coil 492 and rotor 494 are interposed between bearings 332 and drive shaft 496. A bearing retainer nut 498 retains bearings 332 in place; and a motor retainer disc 500 retains motor coil 492 and rotor 494 in place.

Figure 23:
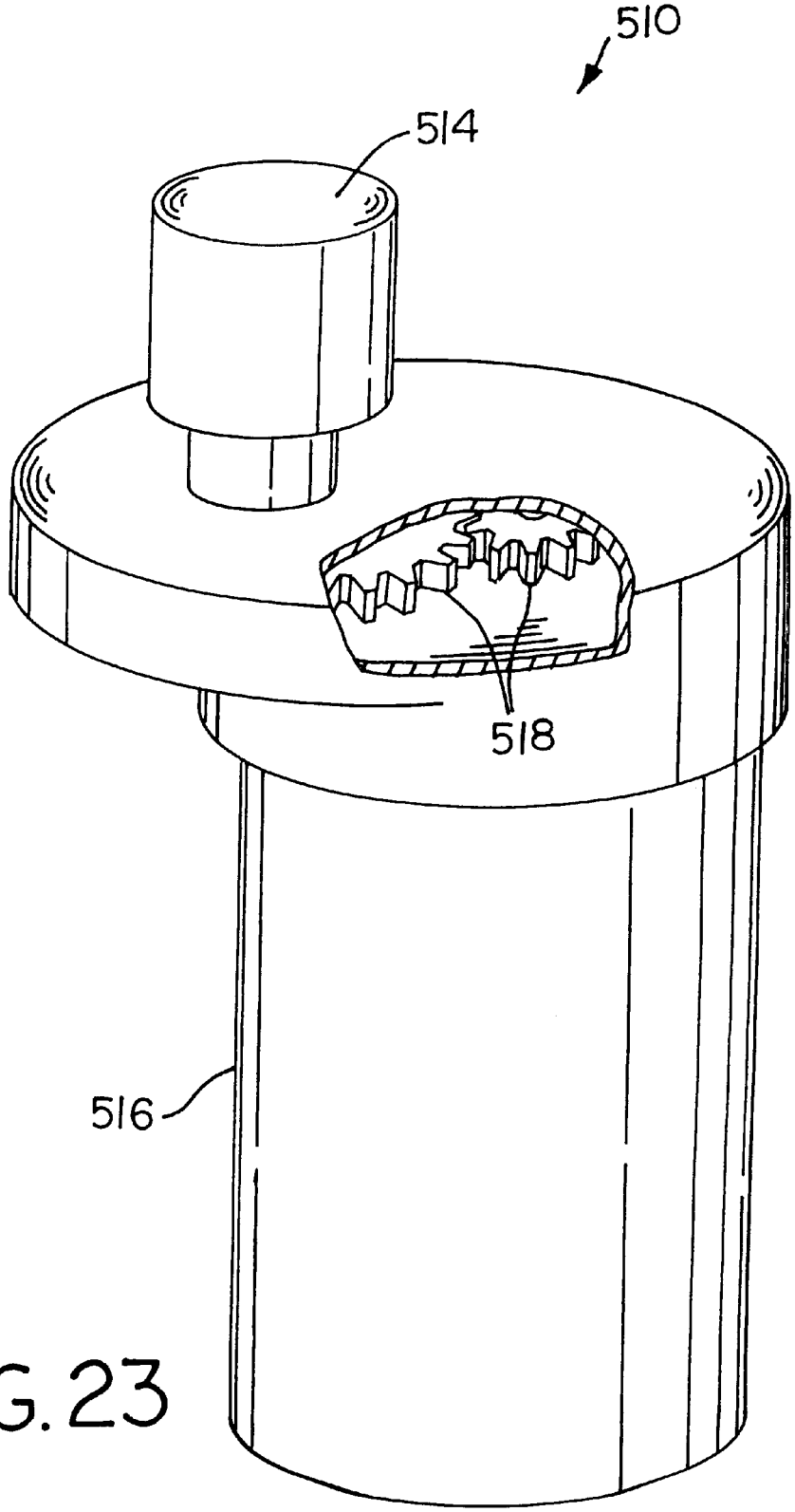
FIG. 23 is a perspective, partially fragmentary view of another embodiment of a centrifugal filter assembly of the present invention.
Figure 24:
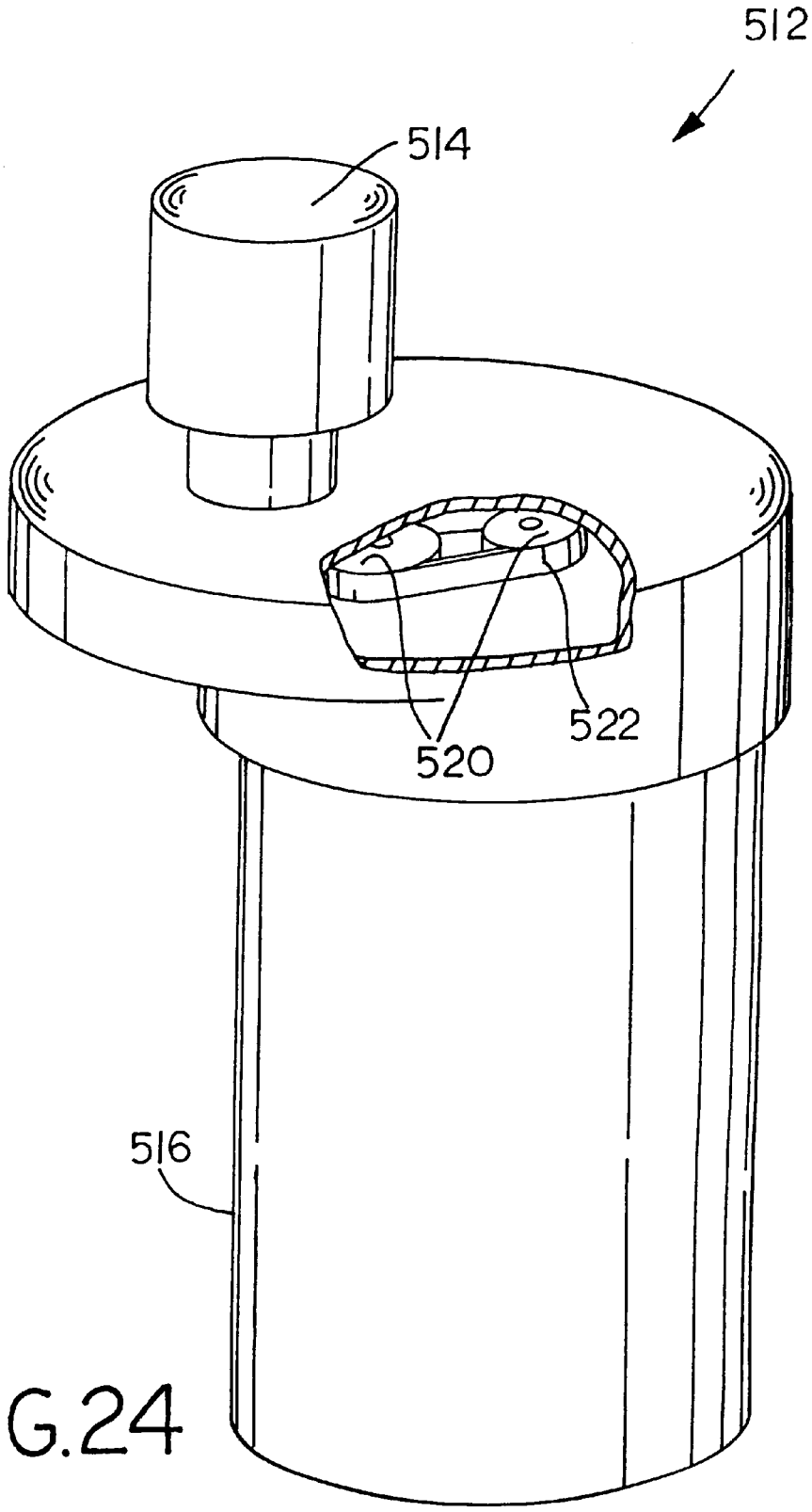
FIG. 24 is a perspective, partially fragmentary view of another embodiment of a centrifugal filter assembly of the present invention.

FIGS. 23 and 24 illustrate further embodiments of centrifugal filter assemblies 510 and 512 of the present invention, respectively. Each filter assembly 510 and 512 includes a motor 514 which may be in form of a brushless DC motor, a hydraulic motor, pneumatic motor, etc. Likewise, each filter assembly 510 and 512 includes a housing 516 which rotatably supports a filter (not shown) therein. Filter assembly 510 includes a gear train with a plurality of gears 518 which are sized to provide a desired rotational speed of the filter within housing 516. Similarly filter assembly 512 includes a plurality of pulleys 520 driven by a common belt 522. Pulleys 520 are sized to provide a desired rotational speed of the filters disposed within housing 516.

Figure 25:
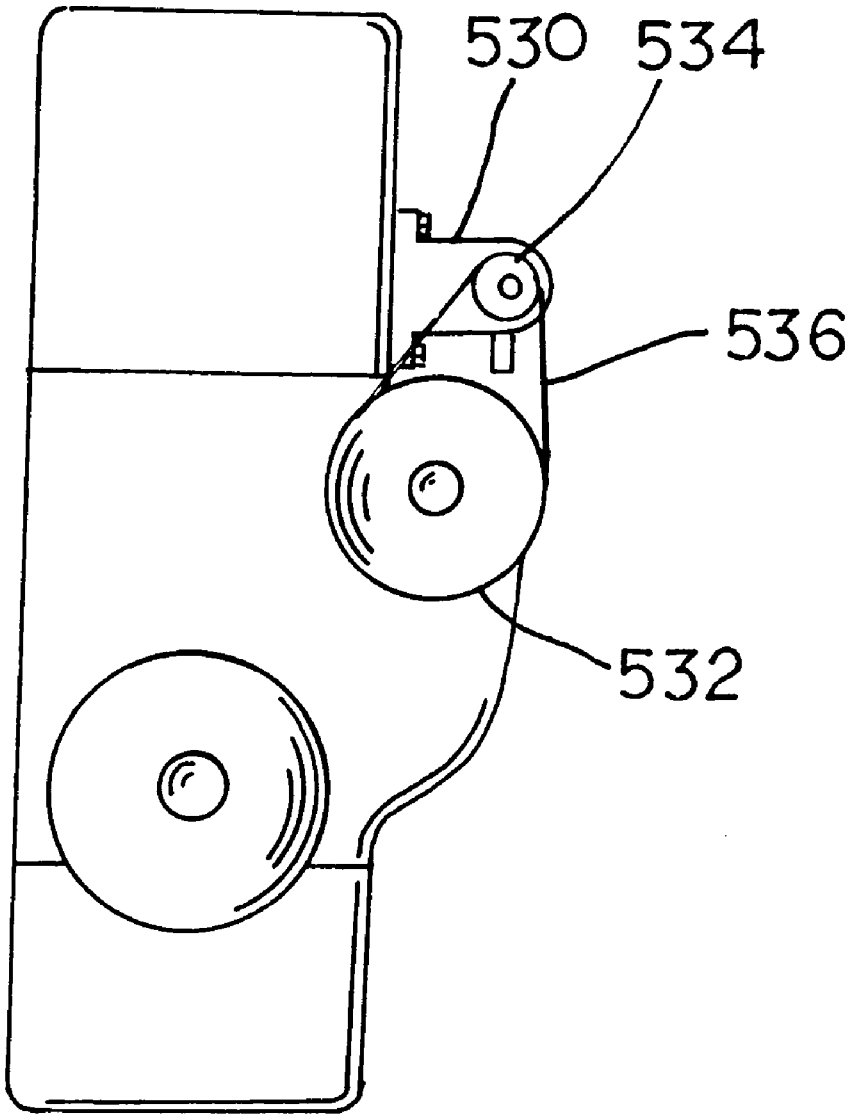
FIGS. 25 and 26 illustrate an embodiment of a gear box which may be used with an internal combustion engine to provide power to a centrifugal filter assembly of the present invention.
Figure 26:
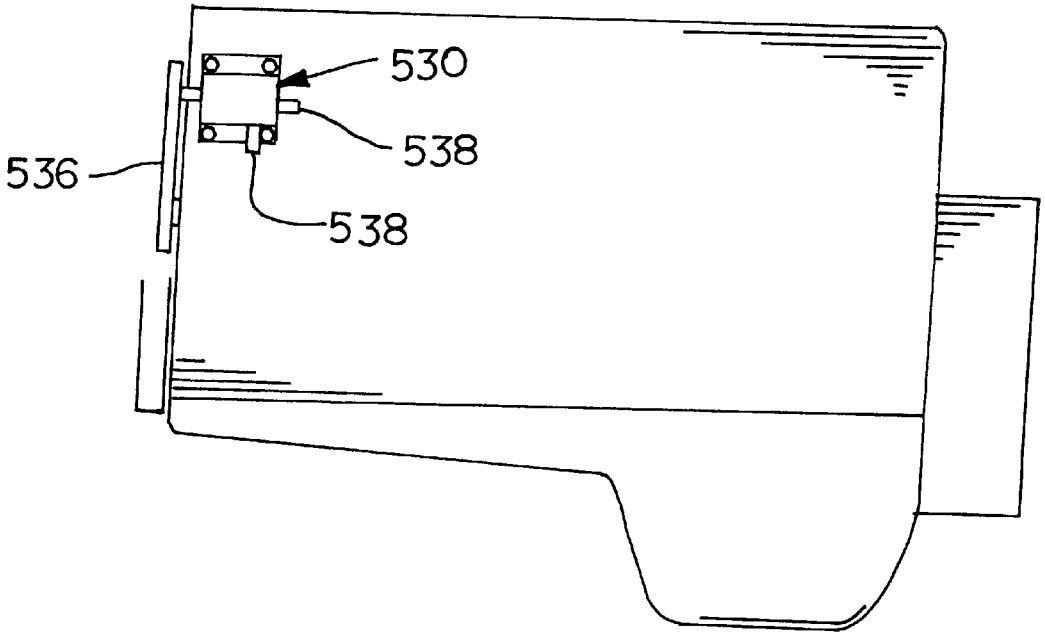

FIGS. 25 and 26 disclose an embodiment of an accessory power source 530 which may be utilized in conjunction with an accessory drive system including an accessory drive pulley 532 of an internal combustion engine. Power source 530 includes an input pulley 534 which is connected via an accessory drive belt 536 with accessory drive pulley 532. Power source 530 includes one or more output shafts 538 which may be used to drive a centrifugal filter assembly of the present invention. In the embodiment shown in FIGS. 25 and 26, power source 530 includes two rotatable output shafts 538 which are respectively oriented in a horizontal and a vertical direction so that a selected output shaft may be easily connected with a centrifugal filter assembly of the present invention. Of course, power source 530 may include appropriate intermediate gearing therein (not shown) to adjust the rotational output speed of output shafts 538.

Figure 27:
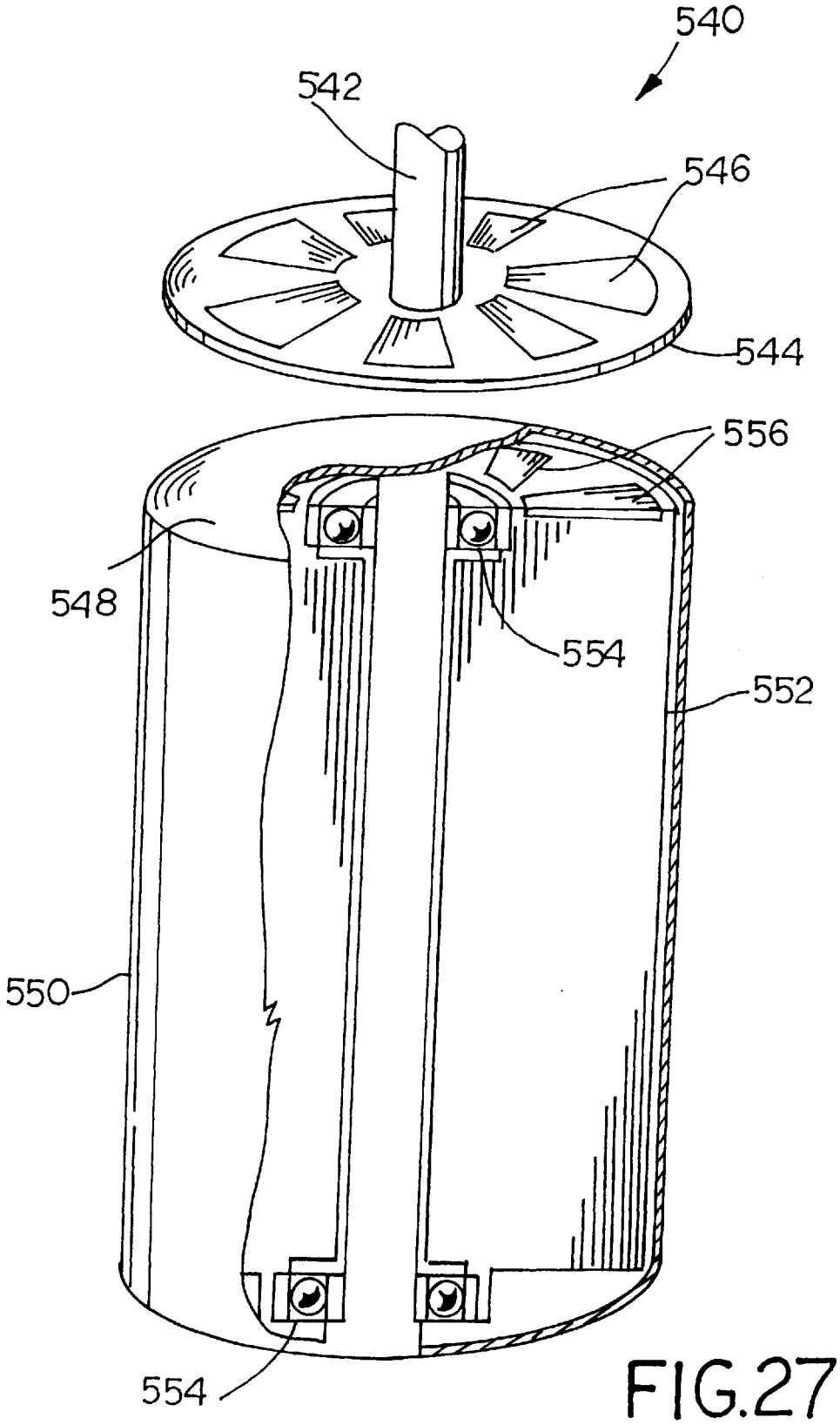
FIG. 27 is a perspective, partially fragmentary view of another embodiment of a centrifugal filter assembly of the present invention.

FIG. 27 illustrates yet another embodiment of a centrifugal filter assembly 540 of the present invention. Filter assembly 540 includes a drive shaft 542 which may be connected with a source of power, such as a brushless DC motor. Drive shaft 542 in turn is connected with a disk 544 which carries a plurality of permanent magnets 546. Disk 544 is positioned axially adjacent to an end 548 of a housing 550. Housing 550 rotatably carries a filter 552 therein, such as by using bearings 554. Filter 552 also carries a plurality of permanent magnets 556 which are positioned adjacent to end 548 on a side opposite from disk 544. End 548 of housing 550 is formed from a non-magnetic material so that magnetic fields generated by each of magnets 546 and 556 may affect each other. During use, drive shaft 542 is rotated which in turn rotates disk 544. Rotation of permanent magnets 546 forms a rotating electromagnetic field which exerts a coupling force on permanent magnets 556 carried by filter 552. Filter 552 thus rotates within housing 550.

Figure 28:
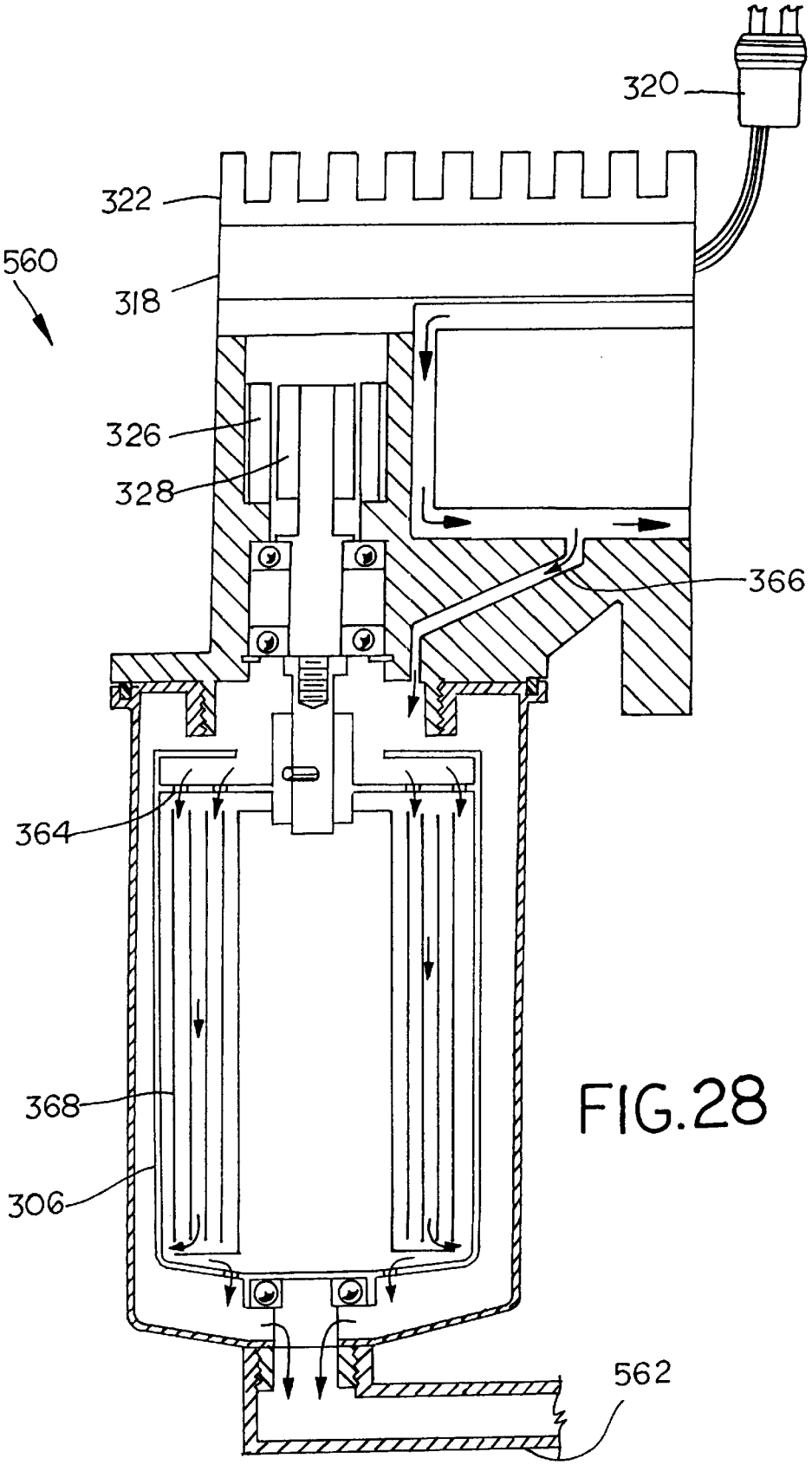
FIG. 28 is a side, sectional view of another embodiment of a centrifugal filter assembly of the present invention.

FIG. 28 illustrates a further embodiment of a centrifugal filter assembly 560 of the present invention. Centrifugal filter assembly 560 is similar to the embodiment of centrifugal filter assembly 300 shown in FIG. 14. However, centrifugal filter assembly 560 includes a gravity drain 562, rather than a venturi which siphons oil through a drain tube.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A centrifugal filter assembly for filtering particulates from engine oil, comprising:

a filter head with a first threaded connector;

a housing with a second threaded connector configured to mate with said first threaded connector, said housing including an open end adjacent said filter head, a first annular seal and a second annular seal at said open end, said open end and said filter head defining a passageway therebetween, at least a portion of said passageway being disposed between said first annular seal and said second annular seal;

a filter disposed within said housing and rotatable relative to said housing about an axis of rotation, said filter having an inlet and an outlet for the oil, said outlet being connected and in communication with said passageway; and a brushless direct current electric motor carried by said filter head, said motor having a rotatable output shaft detachably coupled with said filter for rotating said filter about said axis of rotation.

2. The centrifugal filter assembly of claim 1, further comprising an elongated drive element rotatably carried within said filter head, said drive element disposed coaxially with said filter axis of rotation and interconnecting said motor with said filter.

3. The centrifugal filter assembly of claim 2, wherein said drive element comprises a drive cylinder.

4. The centrifugal filter assembly of claim 2, wherein said drive element comprises a drive shaft.

5. The centrifugal filter assembly of claim 2, wherein said drive element includes at least one drive projection, each said projection engaging said filter for rotatably driving said filter.

6. The centrifugal filter assembly of claim 2, further comprising a pair of reduced friction bearings carried by said housing and carrying said drive element.

7. The centrifugal filter assembly of claim 2, further comprising at least one gear interconnecting said drive element with said filter.

8. The centrifugal filter assembly of claim 2, further comprising at least one pulley interconnecting said drive element with said filter.

9. The centrifugal filter assembly of claim 1, wherein said inlet is positioned generally coaxially with said axis of rotation.

10. The centrifugal filter assembly of claim 1, wherein said motor is disposed within said filter head.

11. The centrifugal filter assembly of claim 1, further comprising a controller carried by said filter head, said controller controlling operation of said motor.

12. A centrifugal filter assembly for filtering particulates from engine oil, comprising:

a filter head with a first threaded connector;

a housing with a second threaded connector configured to mate with said first threaded connector;

a filter disposed within said housing and rotatable relative to said housing about an axis of rotation, said filter having an inlet and an outlet for the oil, said filter head including a venturi section in communication with said outlet, said venturi section configured to create a vacuum within said housing for drawing oil through said outlet; and a brushless direct current electric motor carried by said filter head, said motor having a rotatable output shaft detachably coupled with said filter for rotating said filter about said axis of rotation.

13. The centrifugal filter assembly of claim 12, wherein said inlet is connected with an upstream side of said venturi section.

14. The centrifugal filter assembly of claim 12, wherein said inlet is connected with a downstream side of said venturi section.

15. A centrifugal filter assembly for filtering particulates from engine oil, comprising:

a filter head with a first threaded connector;

a housing with a second threaded connector configured to mate with said first threaded connector;

a filter disposed within said housing and rotatable relative to said housing about an axis of rotation, said filter having an inlet and an outlet for the oil, said filter including an end with a plurality of magnets;

a brushless direct current electric motor carried by said filter head, said motor having a rotatable output shaft detachably coupled with said filter for rotating said filter about said axis of rotation; and an elongated drive element rotatably carried within said filter head, said drive element disposed coaxially with said filter axis of rotation and interconnecting said motor with said filter, said drive element comprising a drive shaft with a disk affixed at an end thereof, said disk disposed adjacent said end of said filter and carrying a plurality of permanent magnets.

16. A centrifugal filter assembly for filtering particulates from engine oil, comprising:

a filter head with a first threaded connector;

a housing with a second threaded connector configured to mate with said first threaded connector, said housing including an open end adjacent said filter head, a first annular seal and a second annular seal with an annular groove therebetween at said open end;

a filter disposed within said housing and rotatable relative to said housing about an axis of rotation, said filter having an inlet and an outlet for the oil, said outlet being connected and in communication with said annular groove; and a brushless direct current electric motor carried by said filter head, said motor having a rotatable output shaft detachably coupled with said filter for rotating said filter about said axis of rotation.

17. The centrifugal filter assembly of claim 16, wherein said outlet comprises a drain tube.

18. A centrifugal filter assembly for filtering particulates from engine oil, comprising:

a filter head with a first threaded connector;

a housing with a second threaded connector configured to mate with said first threaded connector;

a filter disposed within said housing and rotatable relative to said housing about an axis of rotation, said filter having an inlet and an outlet for the oil;

a brushless direct current electric motor carried by said filter head, said motor having a rotatable output shaft detachably coupled with said filter for rotating said filter about said axis of rotation; and a controller carried by said filter head, said controller controlling operation of said motor and including a printed circuit board disposed within said filter head.

19. The centrifugal filter assembly of claim 18, wherein said motor is attached to and carried by said printed circuit board.

20. A centrifugal filter assembly for filtering particulates from engine oil, comprising:

a housing with a threaded connector;

a filter disposed within said housing and rotatable relative to said housing about an axis of rotation, said filter having an inlet and an outlet for the oil;

a filter head with a mating threaded connector configured to mate with said housing threaded connector, said filter head including a venturi section in communication with said outlet, said venturi section configured to create a vacuum within said housing for drawing oil through said outlet;

a brushless direct current electric motor carried by said filter head, said motor having a rotatable output shaft coupled with said filter for rotating said filter about said axis of rotation; and a controller carried by said filter head for controlling operation of said motor, said controller comprising a printed circuit board disposed within said filter head, said motor being attached to and carried by said printed circuit board.

21. The centrifugal filter assembly of claim 20, wherein said inlet is connected with an upstream side of said venturi section.

22. The centrifugal filter assembly of claim 20, wherein said inlet is connected with a downstream side of said venturi section.

23. The centrifugal filter assembly of claim 20, further comprising an elongated drive element rotatably carried within said filter head, said drive element disposed coaxially with said filter axis of rotation and interconnecting said motor with said filter.

24. A centrifugal filter assembly for filtering particulates from engine oil, comprising:

a housing;

a filter disposed within said housing and rotatable relative to said housing about an axis of rotation, said filter having an inlet and an outlet for the oil;

a filter head connected with said housing, said filter head including a venturi section in communication with said outlet, said venturi section configured to create a vacuum within said housing for drawing oil through said outlet; and an electric motor carried by said filter head, said motor having a rotatable output shaft coupled with said filter for rotating said filter about said axis of rotation.

25. A centrifugal filter assembly for filtering particulates from engine oil, comprising:

a housing;

a filter disposed within said housing and rotatable relative to said housing about an axis of rotation, said filter having an inlet and an outlet for the oil, said filter including an end with a plurality of first magnets;

a filter head;

a drive shaft rotatably carried within said filter head, said drive shaft disposed substantially coaxially with said filter axis of rotation, said drive shaft having a disk affixed at an end thereof, said disk disposed adjacent said end of said filter and carrying a plurality of second magnets; and an electric motor carried by said filter head, said motor having a rotatable output shaft coupled with said drive shaft for rotating said disk and thereby inductively rotating said filter about said axis of rotation.

26. A centrifugal filter assembly for filtering particulates from engine oil, comprising:

a filter head;

a housing configured to couple with said filter head, said housing including an open end adjacent said filter head, a first annular seal and a second annular seal at said open end, said open end and said filter head defining a passageway therebetween, at least a portion of said passageway being disposed between said first annular seal and said second annular seal;

a filter disposed within said housing and rotatable relative to said housing about an axis of rotation, said filter having an inlet and an outlet for the oil, said outlet being connected and in communication with said passageway; and a brushless direct current electric motor carried by said filter head, said motor having a rotatable output shaft detachably coupled with said filter for rotating said filter about said axis of rotation.

27. A centrifugal filter assembly for filtering particulates from engine oil, comprising:

a housing;

a filter disposed within said housing and rotatable relative to said housing about an axis of rotation, said filter having an inlet and an outlet for the oil;

a filter head connected with said housing, said filter head including a venturi section in communication with said outlet, said venturi section configured to create a vacuum within said housing for drawing oil through said outlet; and an electric motor having a rotatable output shaft coupled with said filter for rotating said filter about said axis of rotation.

* * * * *